US010757527B2

(12) United States Patent
Seldess

(10) Patent No.: US 10,757,527 B2
(45) **Date of Patent: *Aug. 25, 2020**

(54) CROSSTALK CANCELLATION B-CHAIN

(71) Applicant: Boomcloud 360, Inc., Encinitas, CA (US)

(72) Inventor: Zachary Seldess, San Diego, CA (US)

(73) Assignee: Boomcloud 360, Inc., Encinitas, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/591,352

(22) Filed: Oct. 2, 2019

(65) Prior Publication Data

US 2020/0037095 A1 Jan. 30, 2020

Related U.S. Application Data

(63) Continuation of application No. 16/138,893, filed on Sep. 21, 2018, now Pat. No. 10,524,078.

(Continued)

(51) Int. Cl.
*H04S 7/00* (2006.01)
*H04R 5/02* (2006.01)

(Continued)

(52) U.S. Cl.
CPC ..... *H04S 7/303* (2013.01); *H04R 3/04* (2013.01); *H04R 3/14* (2013.01); *H04R 5/02* (2013.01);

(Continued)

(58) Field of Classification Search
CPC . H04S 1/002; H04S 1/007; H04S 3/04; H04S 3/14; H04S 5/02; H04S 5/04;

(Continued)

(56) References Cited

U.S. PATENT DOCUMENTS 3,920,904 A 11/1975 Blauert et al.
4,975,954 A * 12/1990 Cooper ..... H04S 1/002 381/1

(Continued)

FOREIGN PATENT DOCUMENTS

TW 201732782 A 9/2017
WO WO 2015/054033 A2 4/2015

OTHER PUBLICATIONS

PCT International Search Report and Written Opinion, PCT Application No. PCT/US2018/062487, dated Mar. 20, 2019, 12 pages.

(Continued)

*Primary Examiner* — Xu Mei

(74) *Attorney, Agent, or Firm* — Fenwick & West LLP

(57) ABSTRACT

Embodiments relate to b-chain processing for a spatially enhanced audio signal. A system includes a b-chain processor. The b-chain processor determines asymmetries between the left speaker and the right speaker in frequency response, time alignment, and signal level for a listening position; and generates a left output channel for the left speaker and a right output channel for the right speaker by: applying an N-band equalization to the spatially enhanced signal to adjust for the asymmetry in the frequency response; applying a delay to the spatially enhanced signal to adjust for the asymmetry in the time alignment; and applying a gain to the spatially enhanced signal to adjust for the asymmetry in the signal level.

30 Claims, 15 Drawing Sheets

Related U.S. Application Data

(60) Provisional application No. 62/592,304, filed on Nov. 29, 2017.

(51) Int. Cl.
*H04R 5/04* (2006.01)
*H04R 3/14* (2006.01)
*H04S 1/00* (2006.01)
*H04R 3/04* (2006.01)

(52) U.S. Cl.
CPC ..... *H04R 5/04* (2013.01); *H04S 1/007* (2013.01); *H04S 2400/13* (2013.01)

(58) Field of Classification Search
CPC ..... H04S 7/303; H04S 7/307; H04S 2400/07; H04S 2400/13
USPC ..... 381/1, 17–23, 26, 74, 303, 309, 310
See application file for complete search history.

(56) References Cited

U.S. PATENT DOCUMENTS 5,119,420 A * 6/1992 Kato ..... H04S 1/002 381/1
5,400,405 A * 3/1995 Petroff ..... H04S 1/002 381/1
8,050,433 B2 * 11/2011 Kim ..... H04S 1/002 381/309
9,419,575 B2 8/2016 Bush
10,009,704 B1 6/2018 Allen
10,009,705 B2 6/2018 Seldess et al.
10,255,657 B2 4/2019 Chen et al.
10,313,820 B2 6/2019 Seldess
10,499,153 B1 * 12/2019 Seldess ..... H04R 1/025
10,524,078 B2 * 12/2019 Seldess ..... H04R 3/04
2005/0265558 A1 * 12/2005 Neoran ..... H04S 1/002 381/17
2008/0031462 A1 * 2/2008 Walsh ..... H04S 3/02 381/17
2008/0249769 A1 10/2008 Baumgarte
2008/0273721 A1 11/2008 Walsh
2011/0268281 A1 11/2011 Florencio et al.
2014/0140515 A1 5/2014 Lee et al.
2016/0044431 A1 2/2016 Kraemer et al.
2017/0171672 A1 6/2017 Recker et al.
2017/0230777 A1 8/2017 Seldess et al.
2017/0251322 A1 * 8/2017 Boehm ..... H04S 7/308

OTHER PUBLICATIONS

Taiwan Intellectual Property Office, Office Action, TW Patent Application No. 107142652, Oct. 1, 2019, eight pages (with concise explanation of relevance).

* cited by examiner

CROSSTALK CANCELLATION B-CHAIN

CROSS REFERENCE TO RELATED APPLICATION

This application is a continuation of U.S. patent application Ser. No. 16/138,893, filed Sep. 21, 2018, which claims the benefit of U.S. Provisional Application No. 62/592,304, filed Nov. 29, 2017, each incorporated by reference in its entirety

TECHNICAL FIELD

The subject matter described herein relates to audio signal processing, and more particularly to addressing asymmetries (geometric and physical) when applying audio crosstalk cancellation for speakers.

BACKGROUND

Audio signals may be output to a sub-optimally configured rendering system and/or room acoustics. FIG. 1A illustrates an example of an ideal transaural configuration, i.e. the ideal loudspeaker and listener configuration for a two-channel stereo speaker system, with a single listener in a vacant, soundproof room. As shown in FIG. 1A, the listener 140 is in the ideal position (i.e. "sweet spot") to experience the rendered audio from the left loudspeaker 110L and the right loudspeaker 110R, with the most accurate spatial and timbral reproduction, relative to the original intent of the content creators.

However, there are various situations where the ideal "sweet spot" conditions are not met, or not achievable with audio-emitting devices. These include a situation where the head position of the listener 140 is laterally offset from the ideal "sweet spot" listening position between the stereo loudspeakers 110L and 110R, as shown in FIG. 1B. Or, the listener 140 is in the ideal position, but the distances between each loudspeaker 110L and 110R and the head position of the listener 140 are not equivalent, as shown in FIG. 1C. Furthermore, the listener 140 may be in the ideal position, but the frequency and amplitude characteristics of the loudspeakers 110L and 110R are not equivalent (i.e. the rendering system is "un-matched"), as shown in FIG. 1D. In another example, physical positioning of the listener 140 and the loudspeakers 110L and 110R may be ideal, but one or more of the loudspeakers 110L and 110R may be rotationally offset from the ideal angle, as shown in FIG. 1E for the right loudspeaker 110R.

SUMMARY

Example embodiments relate to b-chain processing for a spatially enhanced audio signal that adjusts for various speaker or environmental asymmetries. Some examples of asymmetries may include time delay between one speaker and the listener being different from that of another speaker, signal level (perceived and objective) between one speaker and the listener being different from that of another speaker, or frequency response between one speaker and the listener being different from that of another speaker.

In some example embodiments, a system for enhancing an input audio signal for a left speaker and a right speaker includes a spatial enhancement processor and a b-chain processor. The spatial enhancement processor generates a spatially enhanced signal by gain adjusting spatial components and nonspatial components of the input audio signal.

The b-chain processor determines asymmetries between the left speaker and the right speaker in frequency response, time alignment, and signal level for a listening position. The b-chain processor generates a left output channel for the left speaker and a right output channel for the right speaker by: applying an N-band equalization to the spatially enhanced signal to adjust for the asymmetry in the frequency response; applying a delay to the spatially enhanced signal to adjust for the asymmetry in the time alignment; and applying a gain to the spatially enhanced signal to adjust for the asymmetry in the signal level.

In some embodiments, the b-chain processor applies the N-band equalization by applying one or more filters to at least one of the left spatially enhanced channel and the right spatially enhanced channel. The one or more filters balance frequency responses of the left speaker and the right speaker, and may include at least one of: a low-shelf filter and a high shelf filter; a band-pass filter; a band-stop filter; a peak-notch filter; and a low-pass filter and a high-pass filter.

In some embodiments, the b-chain processor adjusts at least one of the delay and the gain according to a change in the listening position.

Some embodiments may include a non-transitory computer readable medium storing instructions that, when executed by a processor, configures the processor to: generate a spatially enhanced signal by gain adjusting spatial components and nonspatial components of an input audio signal including a left input channel for a left speaker and a right input channel for a right speaker; determine asymmetries between the left speaker and the right speaker; and generate a left output channel for the left speaker and a right output channel for the right speaker by: applying an N-band equalization to the spatially enhanced signal to adjust for the asymmetry in the frequency response; applying a delay to the spatially enhanced signal to adjust for the asymmetry in the time alignment; and applying a gain to the spatially enhanced signal to adjust for the asymmetry in the signal level.

Some embodiments may include a method for processing an input audio signal for a left speaker and a right speaker. The method may include: generating a spatially enhanced signal by gain adjusting spatial components and nonspatial components of the input audio signal including a left input channel for the left speaker and a right input channel for the right speaker; determining asymmetries between the left speaker and the right speaker in frequency response, time alignment, and signal level for a listening position; and generating a left output channel for the left speaker and a right output channel for the right speaker by: applying an N-band equalization to the spatially enhanced signal to adjust for the asymmetry in the frequency response; applying a delay to the spatially enhanced signal to adjust for the asymmetry in the time alignment; and applying a gain to the spatially enhanced signal to adjust for the asymmetry in the signal level.

The figures depict, and the detail description describes, various non-limiting embodiments for purposes of illustration only.

DETAILED DESCRIPTION

Reference will now be made in detail to embodiments, examples of which are illustrated in the accompanying drawings. In the following detailed description, numerous specific details are set forth in order to provide a thorough understanding of the various described embodiments. However, the described embodiments may be practiced without these specific details. In other instances, well-known methods, procedures, components, circuits, and networks have not been described in detail so as not to unnecessarily obscure aspects of the embodiments.

Embodiments of the present disclosure relate to an audio processing system that provides for spatial enhancement and b-chain processing. The spatial enhancement may include applying subband spatial processing and crosstalk cancellation to an input audio signal. The b-chain processing restores the perceived spatial sound stage of trans-aurally rendered audio on non-ideally configured stereo loudspeaker rendering systems.

A digital audio system, such as can be employed in a cinema or through personal headphones, can be considered as two parts—an a-chain and a b-chain. For instance, in a cinematic environment, the a-chain includes the sound recording on the film print, which is typically available in Dolby analog, and also a selection among digital formats such as Dolby Digital, DTS and SDDS. Also, the equipment that retrieves the audio from the film print and processes it so that it is ready for amplification is part of the a-chain.

The b-chain includes hardware and software systems to apply multi-channel volume control, equalization, time alignment, and amplification to the loudspeakers, in order to correct and/or minimize the effects of sub-optimally configured rendering system installation, room acoustics, or listener position. B-chain processing can be analytically or parametrically configured to optimize the perceived quality of the listening experience, with the general intent of bringing the listener closer to the "ideal" experience.

Example Audio System

Figure 2:
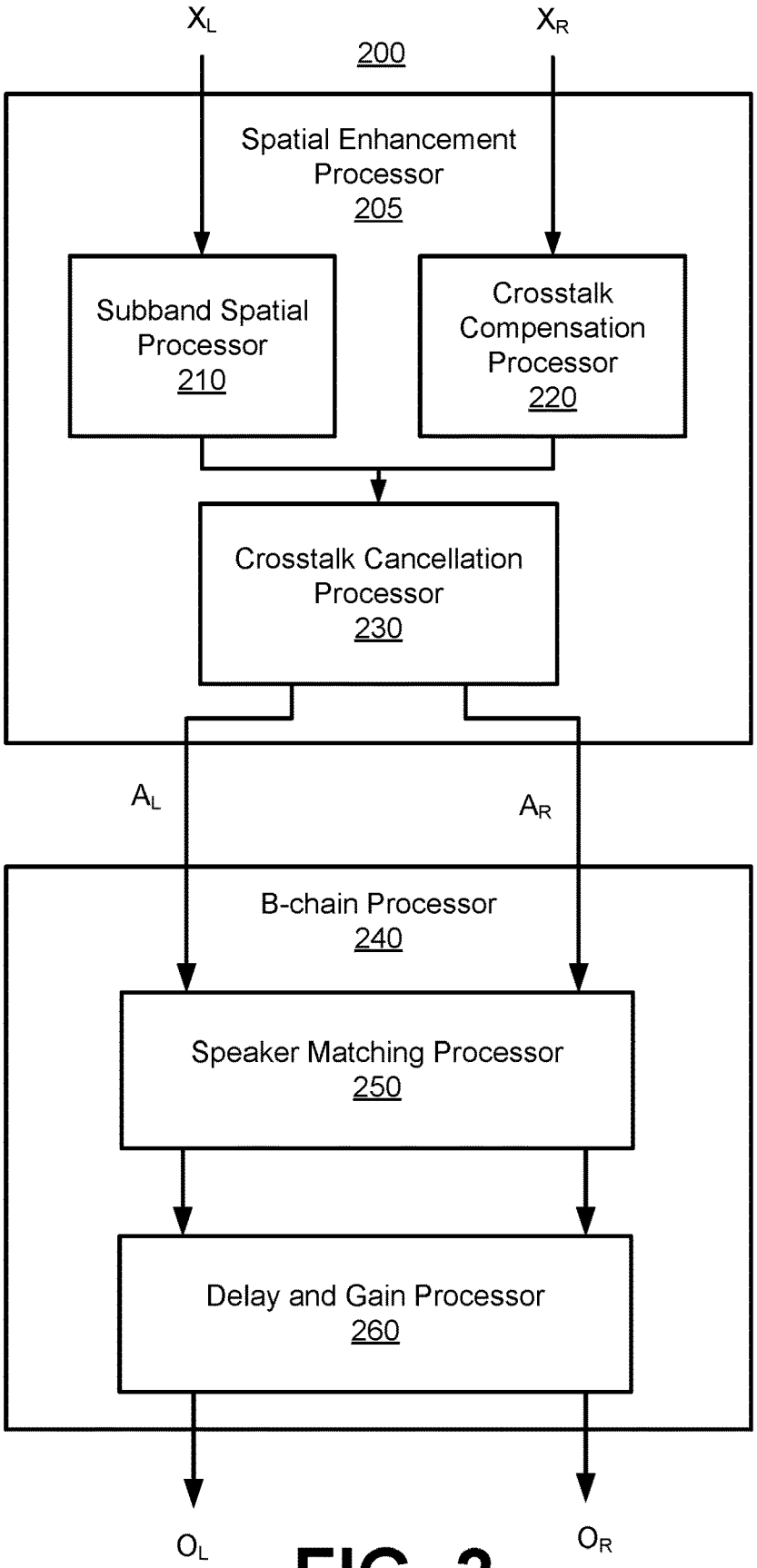
FIG. 2 is a schematic block diagram of an audio processing system, in accordance with some embodiments.

FIG. 2 is a schematic block diagram of an audio processing system 200, in accordance with some embodiments. The audio processing system 200 applies subband spatial processing, crosstalk cancellation processing, and b-chain processing to an input audio signal X including a left input channel XL and a right input channel XR to generate an output audio signal O including a left output channel OL and a right output channel OR. The output audio signal O restores the perceived spatial sound stage for trans-aurally rendered input audio signal X on non-ideally configured stereo loudspeaker rendering systems.

The audio processing system 200 includes a spatial enhancement processor 205 coupled to a b-chain processor 240. The spatial enhancement processor 205 includes a subband spatial processor 210, a crosstalk compensation processor 220, and a crosstalk cancellation processor 230 coupled to the subband spatial processor 210 and the crosstalk compensation processor 220.

The subband spatial processor 210 generates a spatially enhanced audio signal by gain adjusting mid and side subband components of the left input channel XL and the right input channel XR. The crosstalk compensation processor 220 performs a crosstalk compensation to compensate for spectral defects or artifacts in crosstalk cancellation applied by the crosstalk cancellation processor 230. The crosstalk cancellation processor 230 performs the crosstalk cancellation on the combined outputs of the subband spatial processor 210 and the crosstalk compensation processor 220 to generate a left enhanced channel AL and a right enhanced channel AR. Additional details regarding the spatial enhancement processor 210 are discussed below in connection with FIGS. 3 through 6.

The b-chain processor 240 includes a speaker matching processor 250 coupled to a delay and gain processor 260. Among other things, the b-chain processor 240 can adjust for overall time delay difference between loudspeakers 110L and 110R and the listener's head, signal level (perceived and objective) difference between the loudspeakers 110L and 110R and the listener's head, and frequency response difference between the loudspeakers 110L and 110R and the listener's head.

The speaker matching processor 250 receives the left enhanced channel AL and the right enhanced channel AR, and performs loudspeaker balancing for devices that do not provide matched speaker pairs, such as mobile device speaker pairs or other types of left-right speaker pairs. In some embodiments, the speaker matching processor 250 applies an equalization and a gain or attenuation to each of the left enhanced channel AL and the right enhanced channel AR, to provide a spectrally and perceptually balanced stereo image from the vantage point of an ideal listening sweet spot. The delay and gain processor 260 receives the output of the speaker matching processor 250, and applies a delay and a gain or attenuation to each of the channels AL and AR to time align and further perceptually balance the spatial image from a particular listener head position, given the actual physical asymmetries in the rendering/listening system (e.g., off-center head position and/or non-equivalent loudspeaker-to-head distances). The processing applied by the speaker matching processor 250 and the delay and gain processor 260 may be performed in different orders. Additional details regarding the b-chain processor 240 are discussed below in connection with FIG. 7.

Example Spatial Enhancement Processor

Figure 3:
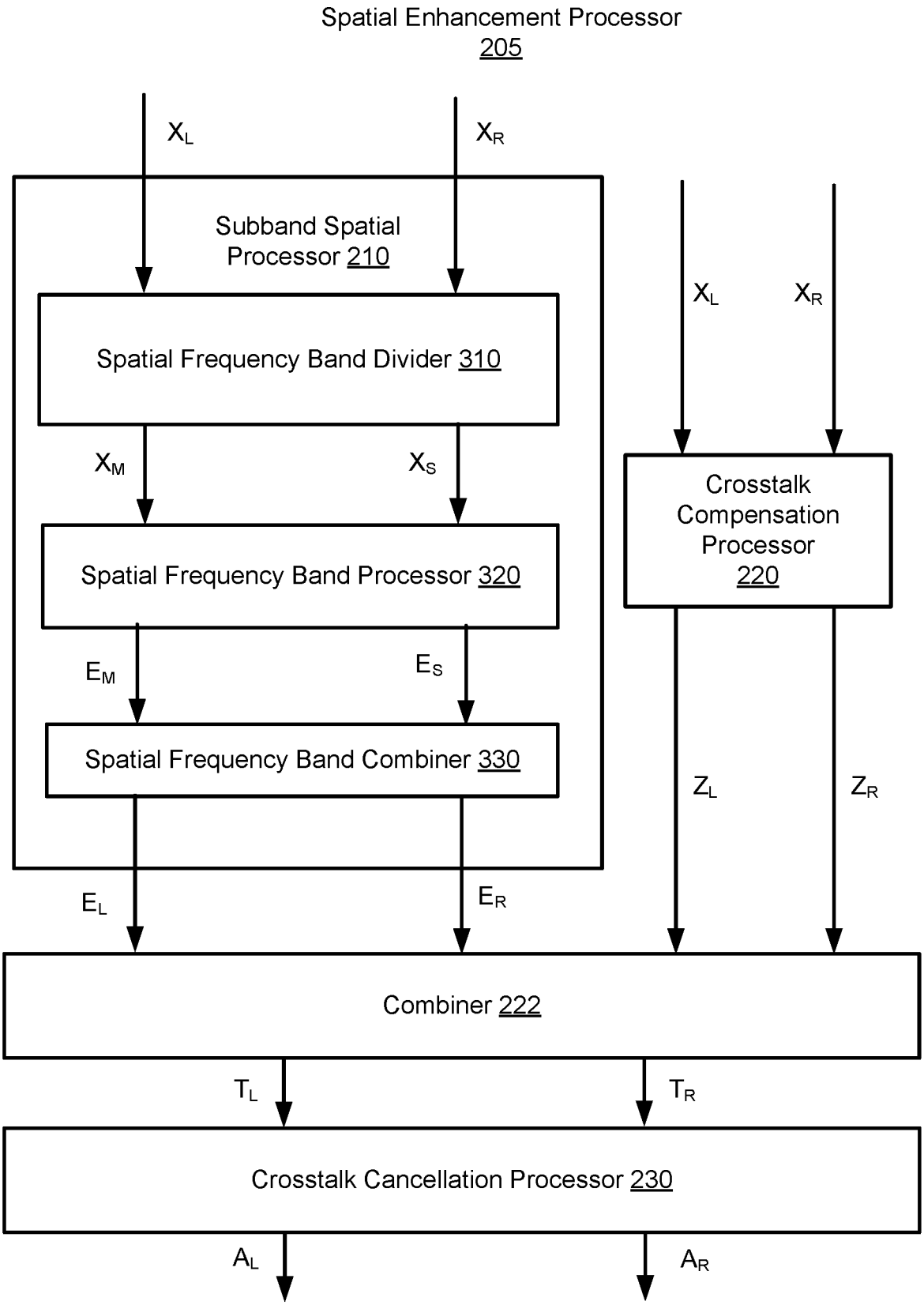
FIG. 3 is a schematic block diagram of a spatial enhancement processor, in accordance with some embodiments.

FIG. 3 is a schematic block diagram of a spatial enhancement processor 205, in accordance with some embodiments. The spatial enhancement processor 205 spatially enhances an input audio signal, and performing crosstalk cancellation on spatially enhanced audio signal. To that end, the spatial enhancement processor 205 receives an input audio signal X including a left input channel XL and a right input channel XR. In some embodiments, the input audio signal X is provided from a source component in a digital bitstream (e.g., PCM data). The source component may be a computer, digital audio player, optical disk player (e.g., DVD, CD, Blu-ray), digital audio streamer, or other source of digital audio signals. The spatial enhancement processor 205 generates an output audio signal A including two output channels AL and AR by processing the input channels XL and XR. The output audio signal A is a spatially enhanced audio signal of the input audio signal X with crosstalk compensation and crosstalk cancellation. Although not shown in FIG. 3, the spatial enhancement processor 205 may further include an amplifier that amplifies the output audio signal A from the crosstalk cancellation processor 230, and provides the signal A to output devices, such as the loudspeakers 110L and 110R, that convert the output channels AL and AR into sound.

The spatial enhancement processor 205 includes a subband spatial processor 210, a crosstalk compensation processor 220, a combiner 222, and a crosstalk cancellation processor 230. The spatial enhancement processor 205 performs crosstalk compensation and subband spatial processing of the input audio input channels XL, XR, combines the result of the subband spatial processing with the result of the crosstalk compensation, and then performs a crosstalk cancellation on the combined signals.

The subband spatial processor 210 includes a spatial frequency band divider 310, a spatial frequency band processor 320, and a spatial frequency band combiner 330. The spatial frequency band divider 310 is coupled to the input channels XL and XR and the spatial frequency band processor 320. The spatial frequency band divider 310 receives the left input channel XL and the right input channel XR, and processes the input channels into a spatial (or "side") component Ys and a nonspatial (or "mid") component Ym. For example, the spatial component Ys can be generated based on a difference between the left input channel XL and the right input channel XR. The nonspatial component Ym can be generated based on a sum of the left input channel XL and the right input channel XR. The spatial frequency band divider 310 provides the spatial component Ys and the nonspatial component Ym to the spatial frequency band processor 320.

The spatial frequency band processor 320 is coupled to the spatial frequency band divider 310 and the spatial frequency band combiner 330. The spatial frequency band processor 320 receives the spatial component Ys and the nonspatial component Ym from spatial frequency band divider 310, and enhances the received signals. In particular, the spatial frequency band processor 320 generates an enhanced spatial component Es from the spatial component Ys, and an enhanced nonspatial component Em from the nonspatial component Ym.

For example, the spatial frequency band processor 320 applies subband gains to the spatial component Ys to generate the enhanced spatial component Es, and applies subband gains to the nonspatial component Ym to generate the enhanced nonspatial component Em. In some embodiments, the spatial frequency band processor 320 additionally or alternatively provides subband delays to the spatial component Ys to generate the enhanced spatial component Es, and subband delays to the nonspatial component Ym to generate the enhanced nonspatial component Em. The subband gains and/or delays can be different for the different (e.g., n) subbands of the spatial component Ys and the nonspatial component Ym, or can be the same (e.g., for two or more subbands). The spatial frequency band processor 320 adjusts the gain and/or delays for different subbands of the spatial component Ys and the nonspatial component Ym with respect to each other to generate the enhanced spatial component Es and the enhanced nonspatial component Em. The spatial frequency band processor 320 then provides the enhanced spatial component Es and the enhanced nonspatial component Em to the spatial frequency band combiner 330.

The spatial frequency band combiner 330 is coupled to the spatial frequency band processor 320, and further coupled to the combiner 222. The spatial frequency band combiner 330 receives the enhanced spatial component Es and the enhanced nonspatial component Em from the spatial frequency band processor 320, and combines the enhanced spatial component Es and the enhanced nonspatial component Em into a left spatially enhanced channel EL and a right spatially enhanced channel ER. For example, the left spatially enhanced channel EL can be generated based on a sum of the enhanced spatial component Es and the enhanced nonspatial component Em, and the right spatially enhanced channel ER can be generated based on a difference between the enhanced nonspatial component Em and the enhanced spatial component Es. The spatial frequency band combiner 330 provides the left spatially enhanced channel EL and the right spatially enhanced channel ER to the combiner 222.

The crosstalk compensation processor 220 performs a crosstalk compensation to compensate for spectral defects or artifacts in the crosstalk cancellation. The crosstalk compensation processor 220 receives the input channels XL and XR, and performs a processing to compensate for any artifacts in a subsequent crosstalk cancellation of the enhanced nonspatial component Em and the enhanced spatial component Es performed by the crosstalk cancellation processor 230. In some embodiments, the crosstalk compensation processor 220 may perform an enhancement on the nonspatial component Xm and the spatial component Xs by applying filters to generate a crosstalk compensation signal Z, including a left crosstalk compensation channel ZL and a right crosstalk compensation channel ZR. In other embodiments, the crosstalk compensation processor 220 may perform an enhancement on only the nonspatial component Xm.

The combiner 222 combines the left spatially enhanced channel EL with the left crosstalk compensation channel ZL to generate a left enhanced compensation channel TL, and combines the right spatially enhanced channel ER with the right crosstalk compensation channel ZR to generate a right enhanced compensation channel TR. The combiner 222 is coupled to the crosstalk cancellation processor 230, and provides the left enhanced compensation channel TL and the right enhanced compensation channel TR to the crosstalk cancellation processor 230.

The crosstalk cancellation processor 230 receives the left enhanced compensation channel TL and the right enhanced compensation channel TR, and performs crosstalk cancellation on the channels TL, TR to generate the output audio signal A including left output channel AL and right output channel AR.

Additional details regarding the subband spatial processor 210 are discussed below in connection with FIG. 4, additional details regarding the crosstalk compensation processors 220 are discussed below in connection with FIG. 5, and additional details regarding the crosstalk cancellation processor 230 are discussed below in connection with FIG. 6.

Figure 4:
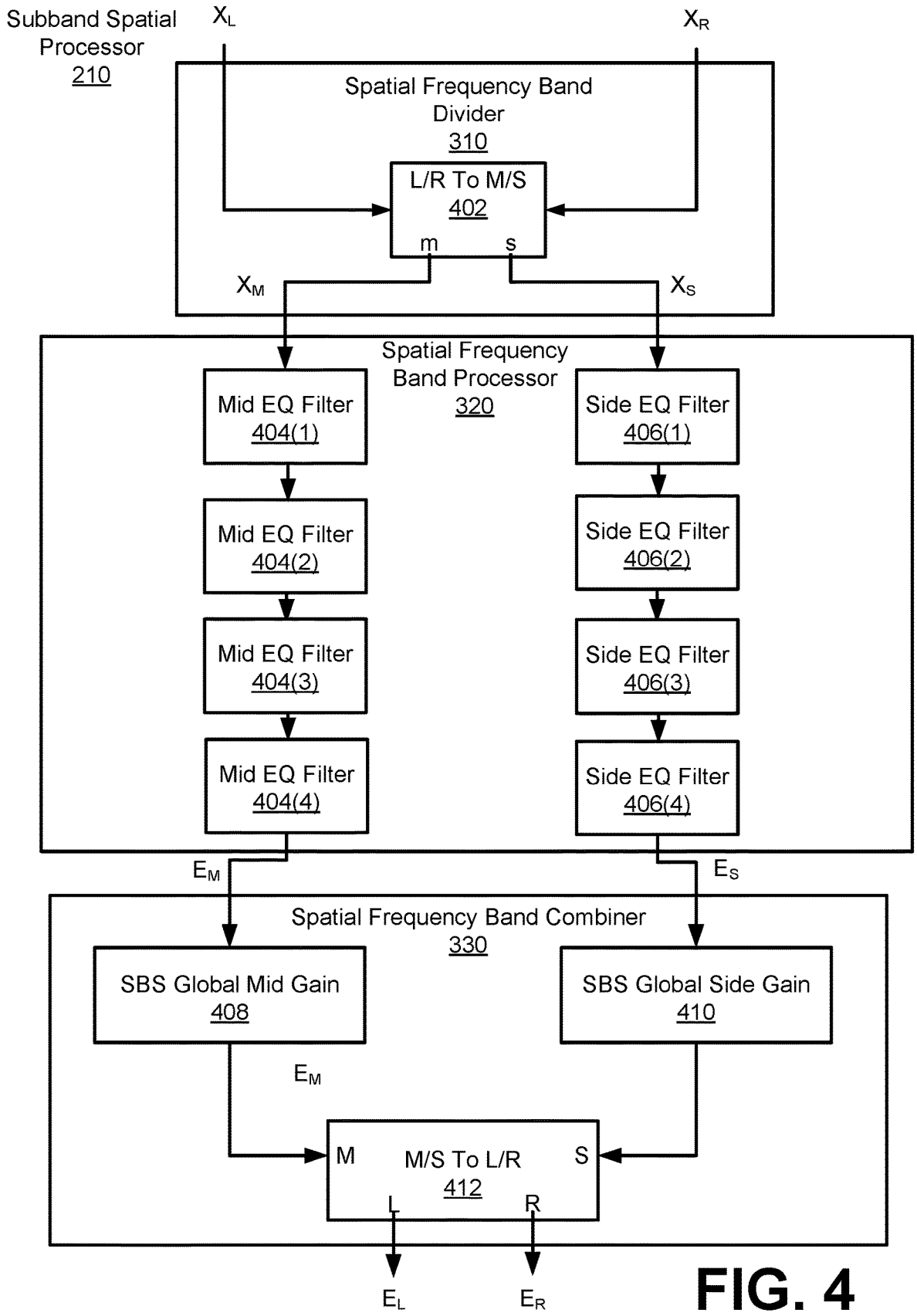
FIG. 4 is a schematic block diagram of a subband spatial processor, in accordance with some embodiments.

FIG. 4 is a schematic block diagram of a subband spatial processor 210, in accordance with some embodiments. The subband spatial processor 210 includes the spatial frequency band divider 310, a spatial frequency band processor 320, and a spatial frequency band combiner 330. The spatial frequency band divider 310 is coupled to the spatial frequency band processor 320, and the spatial frequency band processor 320 is coupled to the spatial frequency band combiner 330.

The spatial frequency band divider 310 includes an L/R to M/S converter 402 that receives a left input channel XL and a right input channel XR, and converts these inputs into a spatial component Xs and the nonspatial component Xm. The spatial component Xs may be generated by subtracting the left input channel XL and right input channel XR. The nonspatial component Xm may be generated by adding the left input channel XL and the right input channel XR.

The spatial frequency band processor 320 receives the nonspatial component Xm and applies a set of subband filters to generate the enhanced nonspatial subband component Em. The spatial frequency band processor 320 also receives the spatial subband component Xs and applies a set of subband filters to generate the enhanced nonspatial subband component Em. The subband filters can include various combinations of peak filters, notch filters, low pass filters, high pass filters, low shelf filters, high shelf filters, bandpass filters, bandstop filters, and/or all pass filters.

In some embodiments, the spatial frequency band processor 320 includes a subband filter for each of n frequency subbands of the nonspatial component Xm and a subband filter for each of the n frequency subbands of the spatial component Xs. For n=4 subbands, for example, the spatial frequency band processor 320 includes a series of subband filters for the nonspatial component Xm including a mid equalization (EQ) filter 404(1) for the subband (1), a mid EQ filter 404(2) for the subband (2), a mid EQ filter 404(3) for the subband (3), and a mid EQ filter 404(4) for the subband (4). Each mid EQ filter 404 applies a filter to a frequency subband portion of the nonspatial component Xm to generate the enhanced nonspatial component Em.

The spatial frequency band processor 320 further includes a series of subband filters for the frequency subbands of the spatial component Xs, including a side equalization (EQ) filter 406(1) for the subband (1), a side EQ filter 406(2) for the subband (2), a side EQ filter 406(3) for the subband (3), and a side EQ filter 406(4) for the subband (4). Each side EQ filter 406 applies a filter to a frequency subband portion of the spatial component Xs to generate the enhanced spatial component Es.

Each of the n frequency subbands of the nonspatial component Xm and the spatial component Xs may correspond with a range of frequencies. For example, the frequency subband (1) may corresponding to 0 to 300 Hz, the frequency subband (2) may correspond to 300 to 510 Hz, the frequency subband (3) may correspond to 510 to 2700 Hz, and the frequency subband (4) may correspond to 2700 Hz to Nyquist frequency. In some embodiments, the n frequency subbands are a consolidated set of critical bands. The critical bands may be determined using a corpus of audio samples from a wide variety of musical genres. A long term average energy ratio of mid to side components over the 24 Bark scale critical bands is determined from the samples. Contiguous frequency bands with similar long term average ratios are then grouped together to form the set of critical bands. The range of the frequency subbands, as well as the number of frequency subbands, may be adjustable. In some embodiments, each of the n frequency bands may include a set of critical bands.

In some embodiments, the mid EQ filters 404 or side EQ filters 406 may include a biquad filter, having a transfer function defined by Equation 1:

$$H(z) = \frac{b_0 + b_1 z^{-1} + b_2 z^{-2}}{a_0 + a_1 z^{-1} + a_2 z^{-2}} \quad \text{Eq. (1)}$$

where z is a complex variable, and $a_0$, $a_1$, $a_2$, $b_0$, $b_1$, and $b_2$ are digital filter coefficients. The filter may be implemented using a direct form I topology as defined by Equation 2:

$$Y[n] = \frac{b_0}{a_0} X[n-1] + \frac{b_1}{a_0} X[n-1] + \frac{b_2}{a_0} X[n-2] - \frac{a_1}{a_0} Y[n-1] - \frac{a_2}{a_0} Y[n-2] \quad \text{Eq. (2)}$$

where X is the input vector, and Y is the output. Other topologies might have benefits for certain processors, depending on their maximum word-length and saturation behaviors.

The biquad can then be used to implement any second-order filter with real-valued inputs and outputs. To design a discrete-time filter, a continuous-time filter is designed and transformed into discrete time via a bilinear transform. Furthermore, compensation for any resulting shifts in center frequency and bandwidth may be achieved using frequency warping.

For example, a peaking filter may include an S-plane transfer function defined by Equation 3:

$$H(s) = \frac{s^2 + s(A/Q) + 1}{s^2 + s(A/Q) + 1} \quad \text{Eq. (3)}$$

where s is a complex variable, A is the amplitude of the peak, and Q is the filter "quality" (canonically derived as:

$$Q = \frac{f_c}{\Delta f}\Big).$$

The digital filters coefficients are:

$$b_0 = 1 + \alpha A$$

$$b_1 = -2 * \cos(\omega_0)$$

$$b_2 = 1 - \alpha A$$

$$a_0 = 1 + \frac{\alpha}{A}$$

$$a_1 = -2\cos(\omega_0)$$

$$a_2 = 1 + \frac{\alpha}{A}$$

where $\omega_0$ is the center frequency of the filter in radians and $$\alpha = \frac{\sin(\omega_0)}{2Q}.$$

The spatial frequency band combiner 330 receives mid and side components, applies gains to each of the components, and converts the mid and side components into left and right channels. For example, the spatial frequency band combiner 330 receives the enhanced nonspatial component Em and the enhanced spatial component Es, and performs global mid and side gains before converting the enhanced nonspatial component Em and the enhanced spatial component Es into the left spatially enhanced channel EL and the right spatially enhanced channel ER.

More specifically, the spatial frequency band combiner 330 includes a global mid gain 408, a global side gain 410, and an M/S to L/R converter 412 coupled to the global mid gain 408 and the global side gain 410. The global mid gain 408 receives the enhanced nonspatial component Em and applies a gain, and the global side gain 410 receives the enhanced spatial component Es and applies a gain. The M/S to L/R converter 412 receives the enhanced nonspatial component Em from the global mid gain 408 and the enhanced spatial component Es from the global side gain 410, and converts these inputs into the left spatially enhanced channel EL and the right spatially enhanced channel ER.

Figure 5:
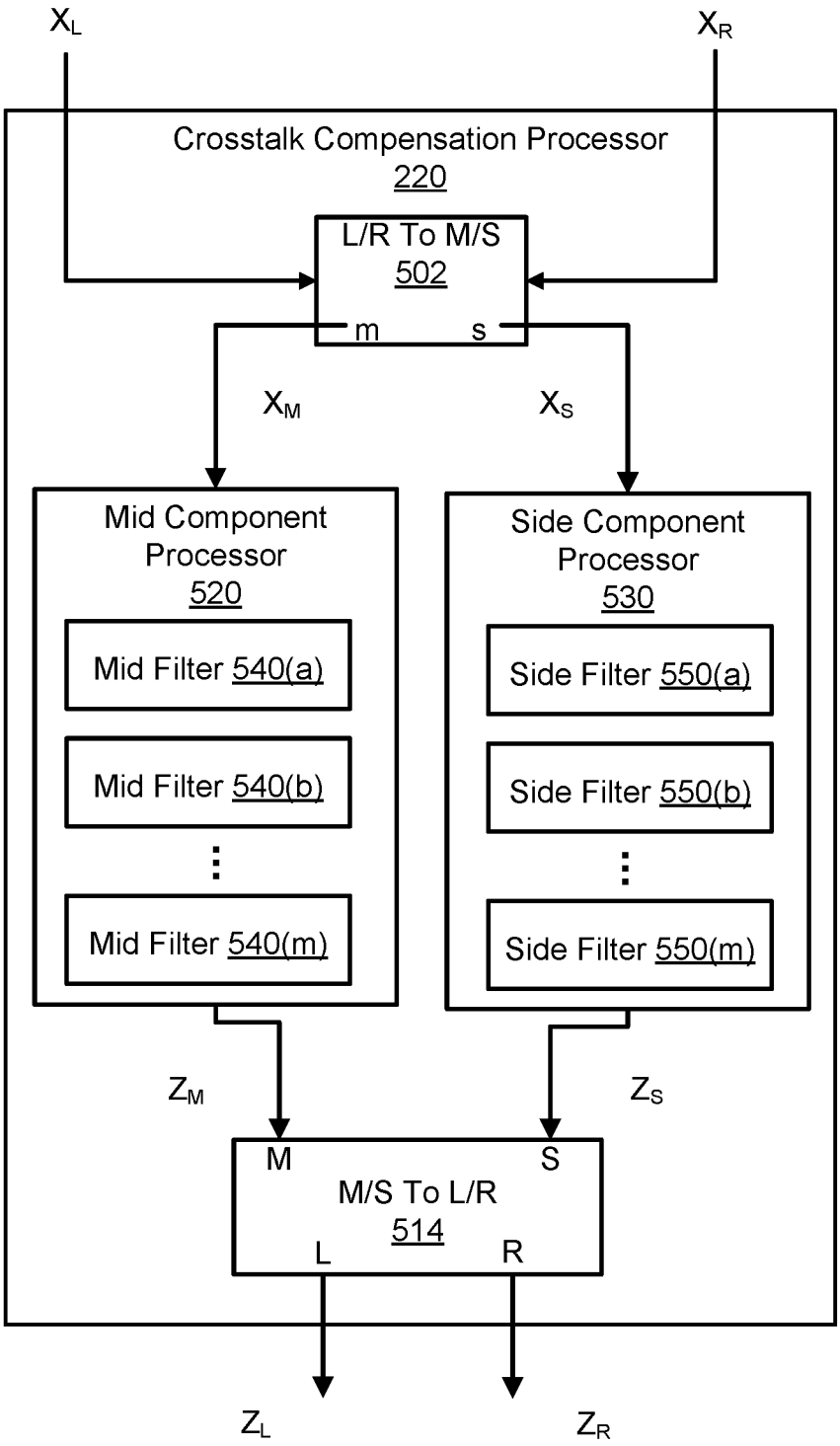
FIG. 5 is a schematic block diagram of a crosstalk compensation processor, in accordance with some embodiments.

FIG. 5 is a schematic block diagram of a crosstalk compensation processor 220, in accordance with some embodiments. The crosstalk compensation processor 220 receives left and right input channels, and generates left and right output channels by applying a crosstalk compensation on the input channels. The crosstalk compensation processor 220 includes a L/R to M/S converter 502, a mid component processor 520, a side component processor 530, and an M/S to L/R converter 514.

When the crosstalk compensation processor 220 is part of the audio system 202, 400, 500, or 504, the crosstalk compensation processor 220 receives the input channels XL and XR, and performs a preprocessing to generate the left crosstalk compensation channel ZL and the right crosstalk compensation channel ZR. The channels ZL, ZR may be used to compensate for any artifacts in crosstalk processing, such as crosstalk cancellation or simulation. The L/R to M/S converter 502 receives the left input audio channel XL and the right input audio channel XR, and generates the nonspatial component Xm and the spatial component Xs of the input channels XL, XR. In general, the left and right channels may be summed to generate the nonspatial component of the left and right channels, and subtracted to generate the spatial component of the left and right channels.

The mid component processor 520 includes a plurality of filters 540, such as m mid filters 540(*a*), 540(*b*), through 540(*m*). Here, each of the m mid filters 540 processes one of m frequency bands of the nonspatial component Xm and the spatial component Xs. The mid component processor 520 generates a mid crosstalk compensation channel Zm by processing the nonspatial component Xm. In some embodiments, the mid filters 540 are configured using a frequency response plot of the nonspatial component Xm with crosstalk processing through simulation. In addition, by analyzing the frequency response plot, any spectral defects such as peaks or troughs in the frequency response plot over a predetermined threshold (e.g., 10 dB) occurring as an artifact of the crosstalk processing can be estimated. These artifacts result primarily from the summation of the delayed and inverted contralateral signals with their corresponding ipsilateral signal in the crosstalk processing, thereby effectively introducing a comb filter-like frequency response to the final rendered result. The mid crosstalk compensation channel Zm can be generated by the mid component processor 520 to compensate for the estimated peaks or troughs, where each of the m frequency bands corresponds with a peak or trough. Specifically, based on the specific delay, filtering frequency, and gain applied in the crosstalk processing, peaks and troughs shift up and down in the frequency response, causing variable amplification and/or attenuation of energy in specific regions of the spectrum. Each of the mid filters 540 may be configured to adjust for one or more of the peaks and troughs.

The side component processor 530 includes a plurality of filters 550, such as m side filters 550(*a*), 550(*b*) through 550(*m*). The side component processor 530 generates a side crosstalk compensation channel Zs by processing the spatial component Xs. In some embodiments, a frequency response plot of the spatial component Xs with crosstalk processing can be obtained through simulation. By analyzing the frequency response plot, any spectral defects such as peaks or troughs in the frequency response plot over a predetermined threshold (e.g., 10 dB) occurring as an artifact of the crosstalk processing can be estimated. The side crosstalk compensation channel Zs can be generated by the side component processor 530 to compensate for the estimated peaks or troughs. Specifically, based on the specific delay, filtering frequency, and gain applied in the crosstalk processing, peaks and troughs shift up and down in the frequency response, causing variable amplification and/or attenuation of energy in specific regions of the spectrum. Each of the side filters 550 may be configured to adjust for one or more of the peaks and troughs. In some embodiments, the mid component processor 520 and the side component processor 530 may include a different number of filters.

In some embodiments, the mid filters 540 or side filters 550 may include a biquad filter having a transfer function defined by Equation 4:

$$H(z) = \frac{b_0 + b_1 z^{-1} + b_2 z^{-2}}{a_0 + a_1 z^{-1} + a_2 z^{-2}} \quad \text{Eq. (4)}$$

where z is a complex variable, and $a_0$, $a_1$, $a_2$, $b_0$, $b_1$, and $b_2$ are digital filter coefficients. One way to implement such a filter is the direct form I topology as defined by Equation 5:

$$Y[n] = \frac{b_0}{a_0} X[n-1] + \frac{b_1}{a_0} X[n-1] + \frac{b_2}{a_0} X[n-2] - \frac{a_1}{a_0} Y[n-1] - \frac{a_2}{a_0} Y[n-2] \quad \text{Eq. (5)}$$

where X is the input vector, and Y is the output. Other topologies may be used, depending on their maximum word-length and saturation behaviors.

The biquad can then be used to implement a second-order filter with real-valued inputs and outputs. To design a discrete-time filter, a continuous-time filter is designed, and then transformed into discrete time via a bilinear transform. Furthermore, resulting shifts in center frequency and bandwidth may be compensated using frequency warping.

For example, a peaking filter may have an S-plane transfer function defined by Equation 6:

$$H(s) = \frac{s^2 + s(A/Q) + 1}{s^2 + s(A/Q) + 1} \quad \text{Eq. (6)}$$

where s is a complex variable, A is the amplitude of the peak, and Q is the filter "quality," and the digital filter coefficients are defined by:

$$b_0 = 1 + \alpha A$$

$$b_1 = -2 * \cos(\omega_0)$$

$$b_2 = 1 - \alpha A$$

$$a_0 = 1 + \frac{\alpha}{A}$$

$$a_1 = -2\cos(\omega_0)$$

$$a_2 = 1 + \frac{\alpha}{A}$$

where $\omega_0$ is the center frequency of the filter in radians and $$\alpha = \frac{\sin(\omega_0)}{2Q}.$$

Furthermore, the filter quality Q may be defined by Equation 7:

$$Q = \frac{f_c}{\Delta f} \quad \text{Eq. (7)}$$

where Δf is a bandwidth and $f_c$ is a center frequency.

The M/S to L/R converter 514 receives the mid crosstalk compensation channel Zm and the side crosstalk compensation channel Zs, and generates the left crosstalk compensation channel ZL and the right crosstalk compensation channel ZR. In general, the mid and side channels may be summed to generate the left channel of the mid and side components, and the mid and side channels may be subtracted to generate right channel of the mid and side components.

Figure 6:
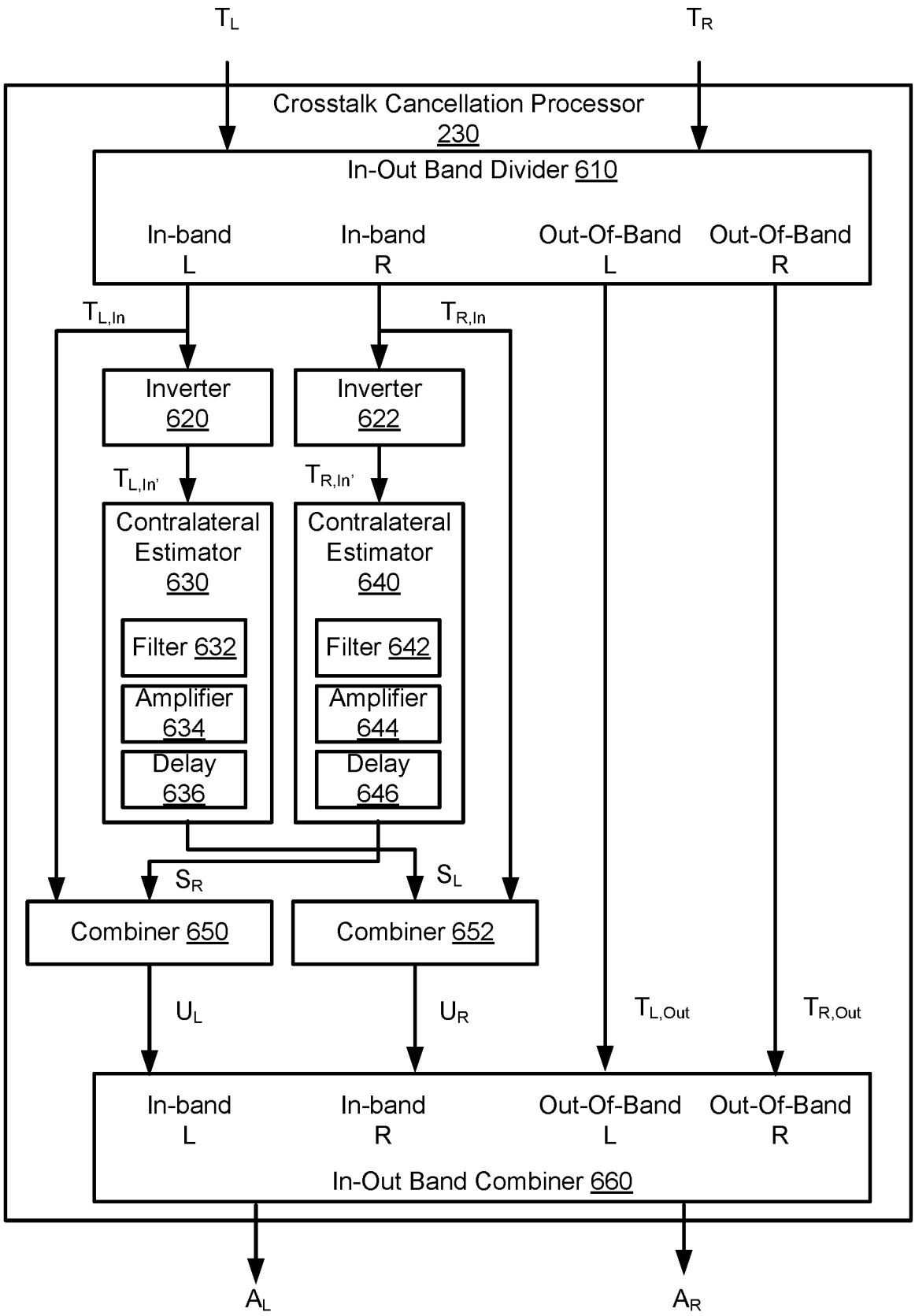
FIG. 6 is a schematic block diagram of a crosstalk cancellation processor, in accordance with some embodiments.

FIG. 6 is a schematic block diagram of a crosstalk cancellation processor 230, in accordance with some embodiments. The crosstalk cancellation processor 230 receives the left enhanced compensation channel TL and the right enhanced compensation channel TR from the combiner 222, and performs crosstalk cancellation on the channels TL, TR to generate the left output channel AL, and the right output channel AR.

The crosstalk cancellation processor 230 includes an in-out band divider 610, inverters 620 and 622, contralateral estimators 630 and 640, combiners 650 and 652, and an in-out band combiner 660. These components operate together to divide the input channels TL, TR into in-band components and out-of-band components, and perform a crosstalk cancellation on the in-band components to generate the output channels AL, AR.

By dividing the input audio signal T into different frequency band components and by performing crosstalk cancellation on selective components (e.g., in-band components), crosstalk cancellation can be performed for a particular frequency band while obviating degradations in other frequency bands. If crosstalk cancellation is performed without dividing the input audio signal T into different frequency bands, the audio signal after such crosstalk cancellation may exhibit significant attenuation or amplification in the nonspatial and spatial components in low frequency (e.g., below 350 Hz), higher frequency (e.g., above 12000 Hz), or both. By selectively performing crosstalk cancellation for the in-band (e.g., between 250 Hz and 14000 Hz), where the vast majority of impactful spatial cues reside, a balanced overall energy, particularly in the nonspatial component, across the spectrum in the mix can be retained.

The in-out band divider 610 separates the input channels TL, TR into in-band channels TL,In, TR,In and out of band channels TL,Out, TR,Out, respectively. Particularly, the in-out band divider 610 divides the left enhanced compensation channel TL into a left in-band channel TL,In and a left out-of-band channel TL,Out. Similarly, the in-out band divider 610 separates the right enhanced compensation channel TR into a right in-band channel TR,In and a right out-of-band channel TR,Out. Each in-band channel may encompass a portion of a respective input channel corresponding to a frequency range including, for example, 250 Hz to 14 kHz. The range of frequency bands may be adjustable, for example according to speaker parameters.

The inverter 620 and the contralateral estimator 630 operate together to generate a left contralateral cancellation component SL to compensate for a contralateral sound component due to the left in-band channel TL,In. Similarly, the inverter 622 and the contralateral estimator 640 operate together to generate a right contralateral cancellation component SR to compensate for a contralateral sound component due to the right in-band channel TR,In.

In one approach, the inverter 620 receives the in-band channel TL,In and inverts a polarity of the received in-band channel TL,In to generate an inverted in-band channel TL,In'. The contralateral estimator 630 receives the inverted in-band channel TL,In', and extracts a portion of the inverted in-band channel TL,In' corresponding to a contralateral sound component through filtering. Because the filtering is performed on the inverted in-band channel TL,In', the portion extracted by the contralateral estimator 630 becomes an inverse of a portion of the in-band channel TL,In attributing to the contralateral sound component. Hence, the portion extracted by the contralateral estimator 630 becomes a left contralateral cancellation component SL, which can be added to a counterpart in-band channel TR,In to reduce the contralateral sound component due to the in-band channel TL,In. In some embodiments, the inverter 620 and the contralateral estimator 630 are implemented in a different sequence.

The inverter 622 and the contralateral estimator 640 perform similar operations with respect to the in-band channel TR,In to generate the right contralateral cancellation component SR. Therefore, detailed description thereof is omitted herein for the sake of brevity.

In one example implementation, the contralateral estimator 630 includes a filter 632, an amplifier 634, and a delay unit 636. The filter 632 receives the inverted input channel TL,In' and extracts a portion of the inverted in-band channel TL,In' corresponding to a contralateral sound component through a filtering function. An example filter implementation is a Notch or Highshelf filter with a center frequency selected between 5000 and 10000 Hz, and Q selected between 0.5 and 1.0. Gain in decibels (GdB) may be derived from Equation 8:

$$G_{dB} = -3.0 - \log_{1.333}(D) \quad \text{Eq. (8)}$$

where D is a delay amount by delay unit 636 in samples, for example, at a sampling rate of 48 KHz.

An alternate implementation is a Lowpass filter with a corner frequency selected between 5000 and 10000 Hz, and Q selected between 0.5 and 1.0. Moreover, the amplifier 634 amplifies the extracted portion by a corresponding gain coefficient $G_{L,In}$, and the delay unit 636 delays the amplified output from the amplifier 634 according to a delay function D to generate the left contralateral cancellation component $S_L$. The contralateral estimator 640 includes a filter 642, an amplifier 644, and a delay unit 646 that performs similar operations on the inverted in-band channel $T_{R,In}'$ to generate the right contralateral cancellation component SR. In one example, the contralateral estimators 630, 640 generate the left and right contralateral cancellation components $S_L$, $S_R$, according to equations below:

$$S_L=D[G_{L,In}*F[T_{L,In}']] \quad \text{Eq. (9)}$$

$$S_R=D[G_{R,In}*F[T_{R,In}']] \quad \text{Eq. (10)}$$

where F[ ] is a filter function, and D [ ] is the delay function.

The configurations of the crosstalk cancellation can be determined by the speaker parameters. In one example, filter center frequency, delay amount, amplifier gain, and filter gain can be determined, according to an angle formed between two speakers 110 with respect to a listener. In some embodiments, values between the speaker angles are used to interpolate other values.

The combiner 650 combines the right contralateral cancellation component SR to the left in-band channel TL,In to generate a left in-band compensation channel UL, and the combiner 652 combines the left contralateral cancellation component SL to the right in-band channel TR,In to generate a right in-band compensation channel UR. The in-out band combiner 660 combines the left in-band compensation channel UL with the out-of-band channel TL,Out to generate the left output channel AL, and combines the right in-band compensation channel UR with the out-of-band channel TR,Out to generate the right output channel AR.

Accordingly, the left output channel AL includes the right contralateral cancellation component SR corresponding to an inverse of a portion of the in-band channel TR,In attributing to the contralateral sound, and the right output channel AR includes the left contralateral cancellation component SL corresponding to an inverse of a portion of the in-band channel TL,In attributing to the contralateral sound. In this configuration, a wavefront of an ipsilateral sound component output by the loudspeaker 110R according to the right output channel AR arrived at the right ear can cancel a wavefront of a contralateral sound component output by the loudspeaker 110L according to the left output channel AL. Similarly, a wavefront of an ipsilateral sound component output by the speaker 110L according to the left output channel AL arrived at the left ear can cancel a wavefront of a contralateral sound component output by the loudspeaker 110R according to right output channel AR. Thus, contralateral sound components can be reduced to enhance spatial detectability.

Example B-Chain Processor

Figure 7:
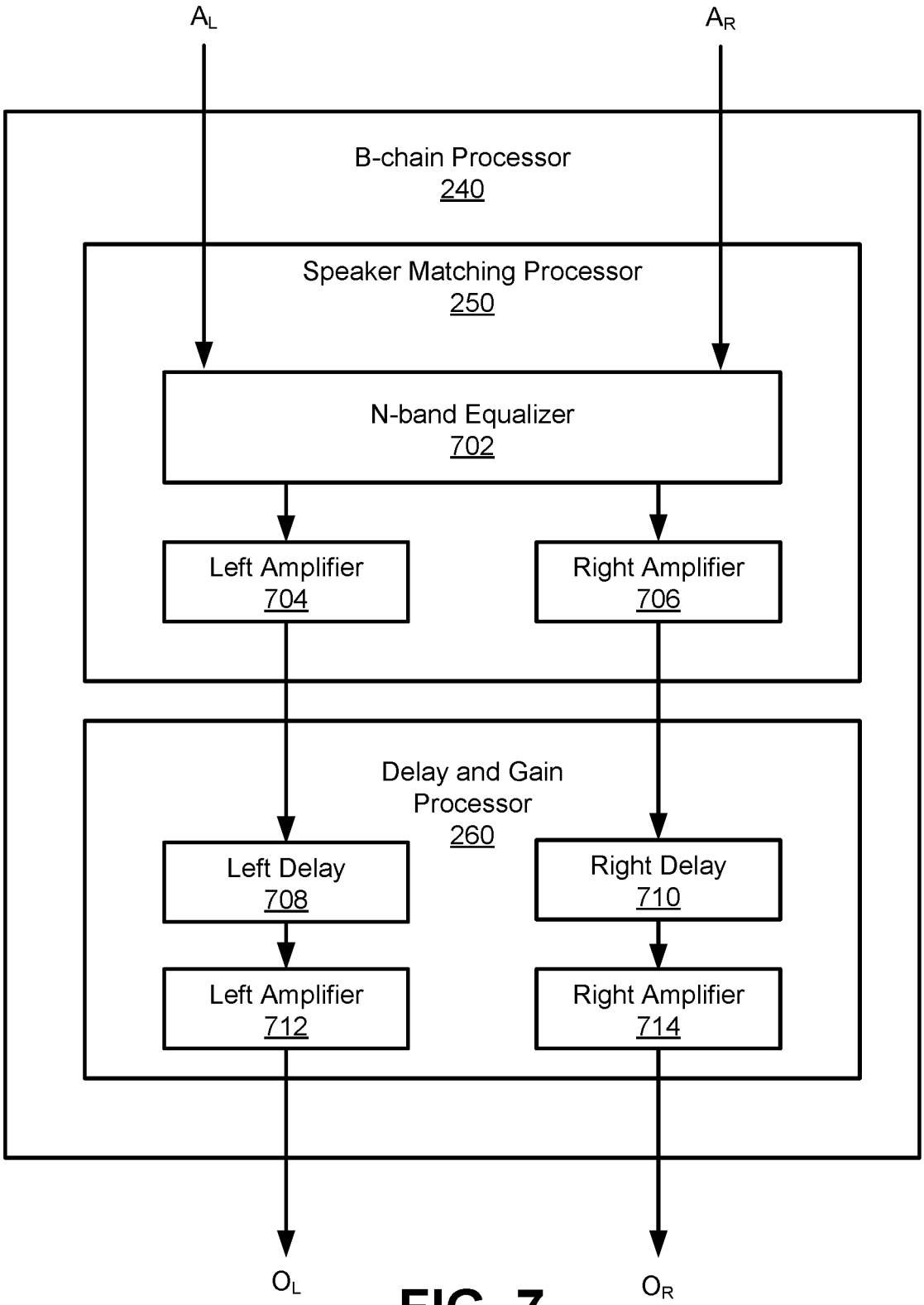
FIG. 7 is a schematic block diagram of a b-chain processor, in accordance with some embodiments.

FIG. 7 is a schematic block diagram of a b-chain processor 240, in accordance with some embodiments. The b-chain processor 240 includes the speaker matching processor 250 and the delay and gain processor 260. The speaker matching processor 250 includes an N-band equalizer (EQ) 702 coupled to a left amplifier 704 and a right amplifier 706. The delay and gain processor 260 includes a left delay 708 coupled to a left amplifier 712, and a right delay 710 coupled to a right amplifier 714.

Assuming the orientation of the listener 140 remains fixed towards the center of an ideal spatial image, as shown in FIGS. 1A through 1E (e.g., the virtual lateral center of the sound stage, given symmetric, matched, and equidistant loudspeakers), the transformational relationship between the ideal and real rendered spatial image can be described based on (a) overall time delay between one speaker and the listener 140 being different from that of another speaker, (b) signal level (perceived and objective) between one speaker and the listener 140 being different from that of another speaker, and (c) frequency response between one speaker and the listener 140 being different from that of another speaker.

The b-chain processor 240 corrects the above relative differences in delay, signal level, and frequency response, resulting in a restored near-ideal spatial image, as if the listener 140 (e.g., head position) and/or rendering system were ideally configured.

Figure 1A:
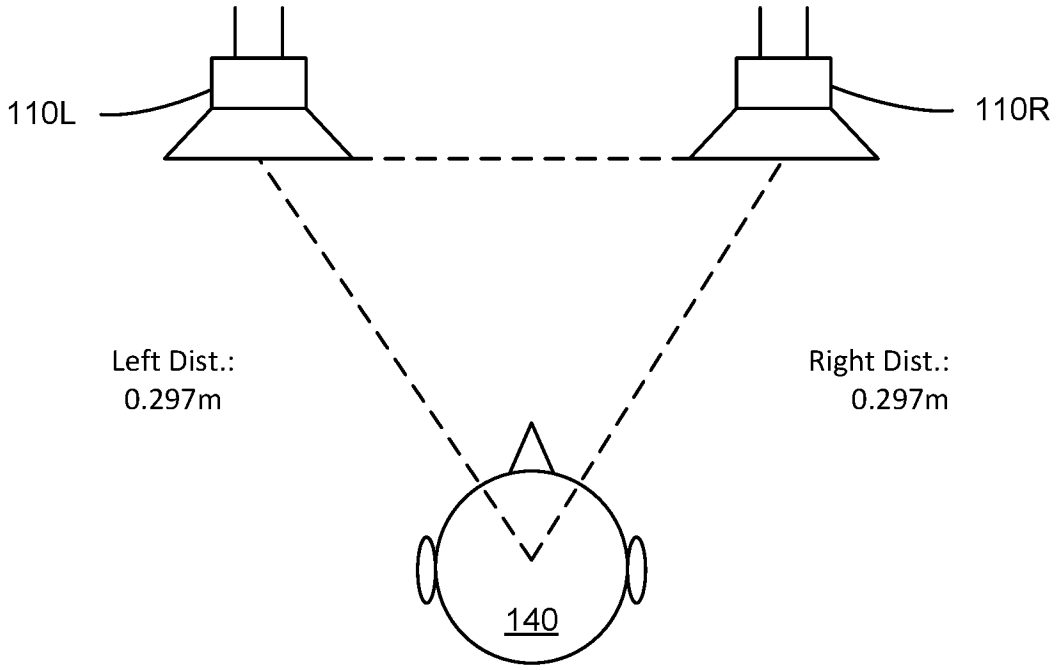
FIGS. 1A, 1B, IC, 1D, and 1E illustrate loudspeaker positions relative to a listener, in accordance with some embodiments.

The b-chain processor 240 receives as input the audio signal A including the left enhanced channel AL and the right enhanced channel AR from the spatial enhancement processor 205. The input to the b-chain processor 240 may include any transaurally processed stereo audio stream for a given listener/speaker configuration in its ideal state (as illustrated in FIG. 1A). If the audio signal A has no spatial asymmetries and if no other irregularities exist in the system, the spatial enhancement processor 205 provides a dramatically enhanced sound stage for the listener 140. However, if asymmetries do exist in the system, as described above and illustrated in FIGS. 1B through 1E, the b-chain processor 240 may be applied to retain the enhanced sound stage under non-ideal conditions.

Figure 1B:
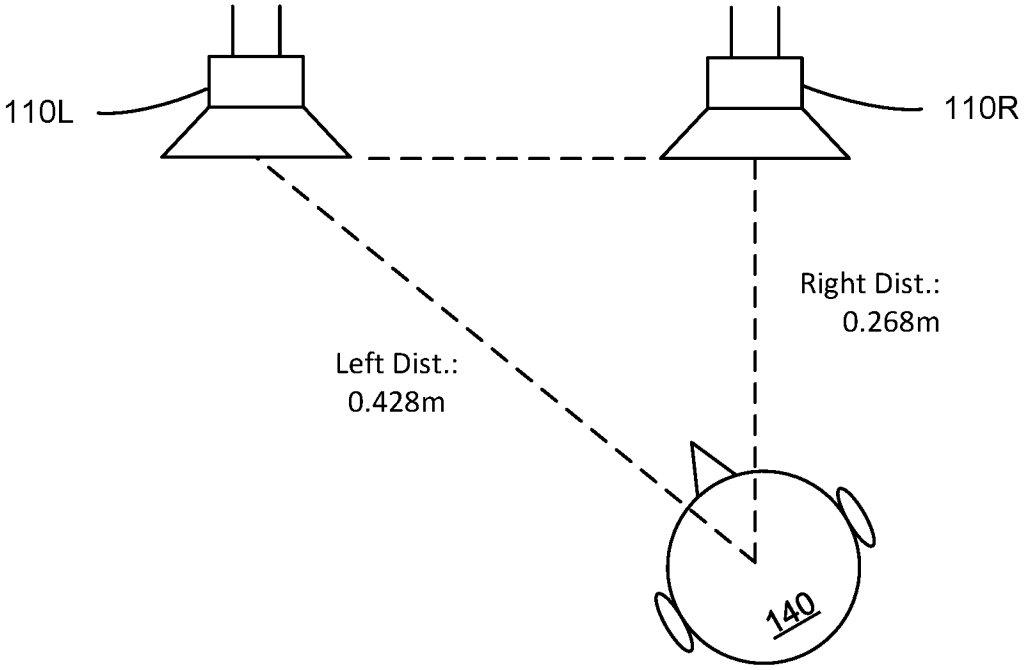
Figure 1C:
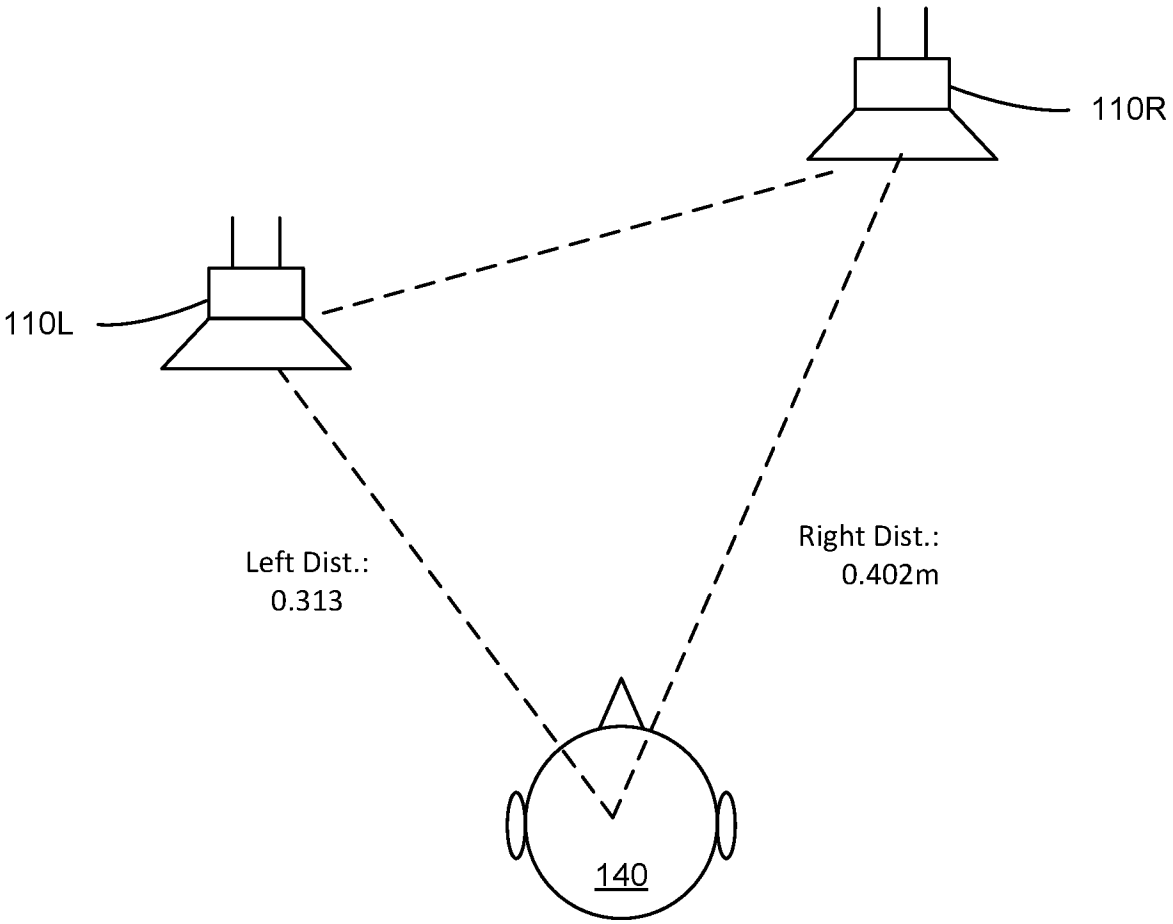
Figure 1D:
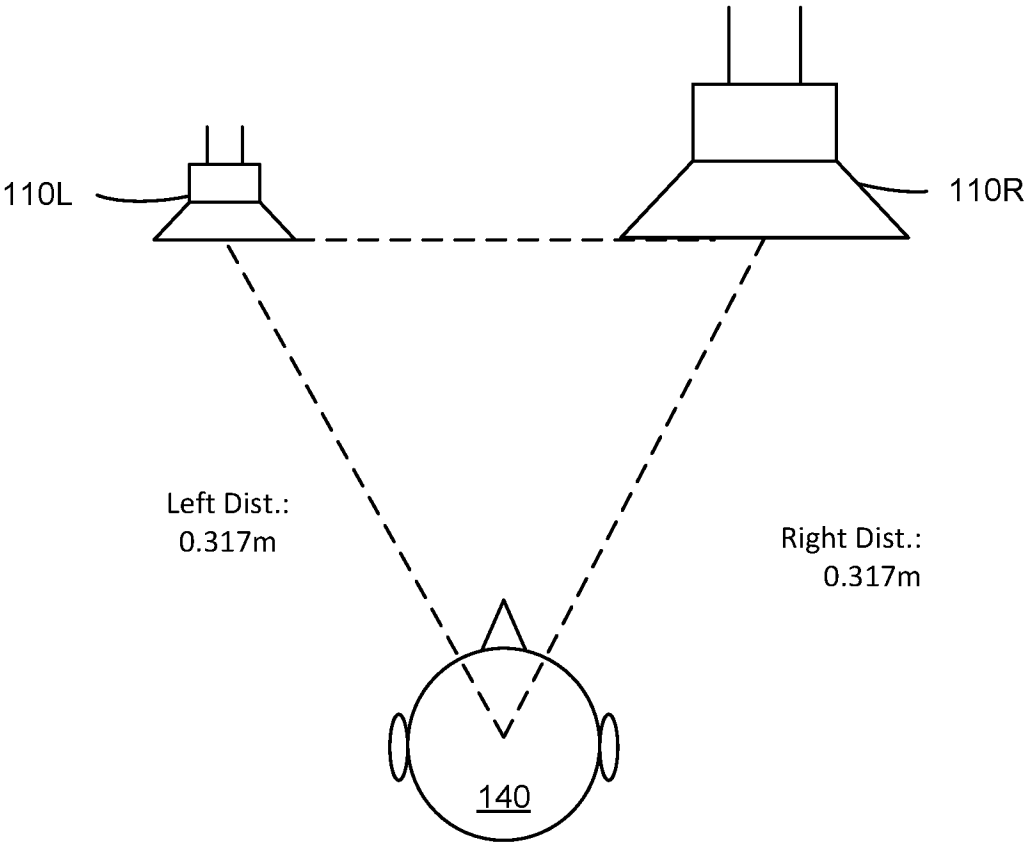
Figure 1E:
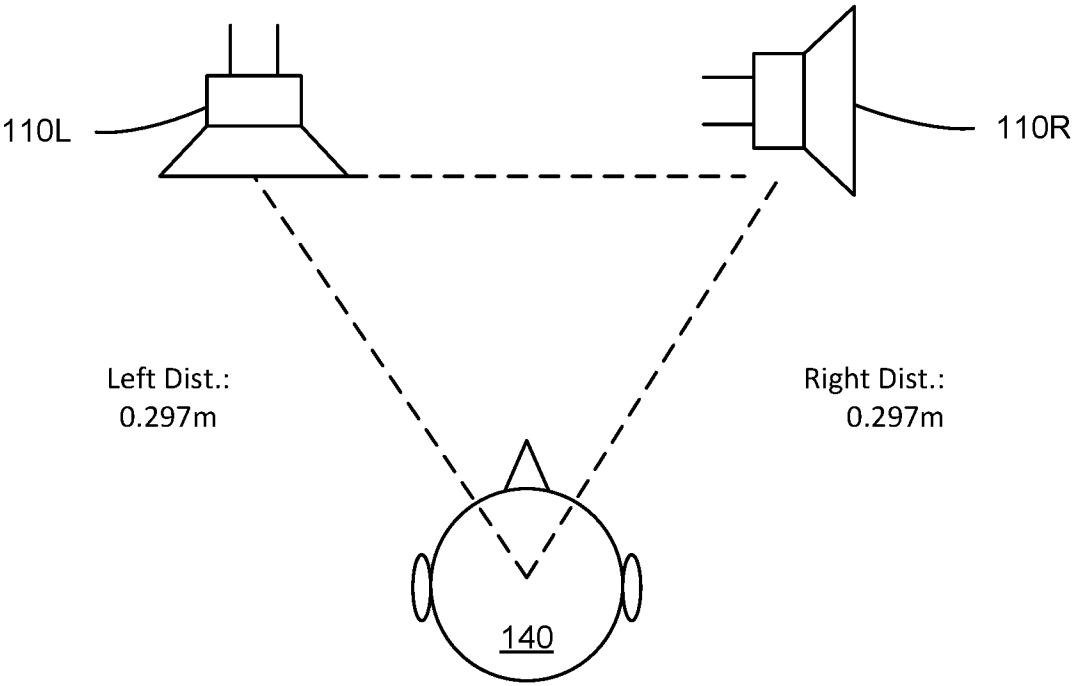

Whereas the ideal listener/speaker configuration includes a pair of loudspeakers with matching left and right speaker-to-head distances, many real-world setups do not meet these criteria, resulting in a compromised stereo listening experience. Mobile devices, for example, may include a front facing earpiece loudspeaker with limited bandwidth (e.g. 1000-8000 Hz frequency response), and an orthogonally (down or side-ward) facing micro-loudspeaker (e.g., 200-20000 Hz frequency response). Here, the speaker system is unmatched in a two-fold manner, with audio driver performance characteristics (e.g., signal level, frequency response, etc.) being different, and time alignment relative to the "ideal" listener position being un-matched because the non-parallel orientation of the speakers. Another example is where a listener using a stereo desktop loudspeaker system does not arrange either the loudspeakers or themselves in the ideal configuration (e.g., as shown in FIG. 1B, 1C, or 1E). The b-chain processor 240 thus provides for tuning of the characteristics of each channel, addressing associated system-specific asymmetries, resulting in a more perceptually compelling transaural sound stage.

After spatial enhancement processing or some other processing has been applied to the stereo input signal X, tuned under the assumption of an ideally configured system (i.e. listener in sweet spot, matched, symmetrically placed loudspeakers, etc.), the speaker matching processor 250 provides practical loudspeaker balancing for devices that do not provide matched speaker pairs, as is the case in the vast majority of mobile devices. The N-band EQ 702 of the speaker matching processor 250 receives the left enhanced channel AL and the right enhanced channel AR, and applies an equalization to each of the channels AL and AR.

In some embodiments, the N-band EQ 702 provides various EQ filter types such as a low and high-shelf filter, a band-pass filter, a band-stop filter, and peak-notch filter, or low and high pass filter. If one loudspeaker in a stereo pair is angled away from the ideal listener sweet spot, for example, that loudspeaker will exhibit noticeable high-frequency attenuation from the listener sweet spot. One or more bands of the N-band EQ 702 can be applied on that loudspeaker channel in order to restore the high frequency energy when observed from the sweet spot (e.g., via high-shelf filter), achieving a near-match to the characteristics of the other forward facing loudspeaker. In another scenario, if both loudspeakers are front-facing but one of them has a vastly different frequency response, then EQ tuning can be applied to both left and right channels to strike a spectral balance between the two. Applying such tunings can be equivalent to "rotating" the loudspeaker of interest to match the orientation of the other, forward-facing loudspeaker. In some embodiments, the N-band EQ 702 includes a filter for each of n bands that are processed independently. The number of bands may vary. In some embodiments, the number of bands correspond with the subbands of the subband spatial processing.

In some embodiments, speaker asymmetry may be predefined for a particular set of speakers, with the known asymmetry being used as a basis for selecting parameters of the N-band EQ 702. In another example, speaker asymmetry may be determined based on testing the speakers, such as by using test audio signals, recording the sound generated from the signals by the speakers, and analyzing the recorded sound.

The left amplifier 704 is coupled to the N-band EQ 702 to receive a left channel and the right amplifier 706 is coupled to the N-band EQ 702 to receive a right channel. The amplifiers 704 and 706 address asymmetries in loudspeaker loudness and dynamic range capabilities by adjusting the output gains on one or both channels. This is especially useful for balancing any loudness offsets in loudspeaker distances from the listening position, and for balancing unmatched loudspeaker pair that have vastly different sound pressure level (SPL) output characteristics.

The delay and gain processor 260 receives left and right output channels of the speaker matching processor 250, and applies a time delay and gain or attenuation to one or more of the channels. To that end, the delay and gain processor 260 includes the left delay 708 that receives the left channel output from the speaker matching processor 250 and applies a time delay, and the left amplifier 712 that applies a gain or attenuation to the left channel to generate the left output channel OL. The delay and gain processor 260 further includes the right delay 710 that receives the right channel output from the speaker matching processor 250, and applies a time delay, and the right amplifier 714 that applies a gain or attenuation to the right channel to generate the right output channel OR. As discussed above, the speaker matching processor 250 perceptually balances the left/right spatial image from the vantage of an ideal listener "sweet spot," focusing on providing a balanced SPL and frequency response for each driver from that position, and ignoring time-based asymmetries that exist in the actual configuration. After this speaker matching is achieved, the delay and gain processor 260 time aligns and further perceptually balances the spatial image from a particular listener head position, given the actual physical asymmetries in the rendering/listening system (e.g., off-center head position and/or non-equivalent loudspeaker-to-head distances).

The delay and gain values applied by the delay and gain processor 260 may be set to address a static system configuration, such as a mobile phone employing orthogonally oriented loudspeakers, or a listener laterally offset from the ideal listening sweet spot in front of a speaker, such as a home theater soundbar, for example.

The delay and gain values applied by the delay and gain processor 260 may also be dynamically adjusted based on changing spatial relationships between the listener's head and the loudspeakers, as might occur in a gaming scenario employing physical movement as a component of game play (e.g., location tracking using a depth-camera, such as for gaming or artificial reality systems). In some embodiments, an audio processing system includes a camera, light sensor, proximity sensor, or some other suitable device that is used to determine the location of the listener's head relative to the speakers. The determined location of the user's head may be used to determine the delay and gain values of the delay and gain processor 260.

Audio analysis routines can provide the appropriate inter-speaker delays and gains used to configure the b-chain processor 240, resulting in a time-aligned and perceptually balanced left/right stereo image. In some embodiments, in the absence of measurable data from such analysis methods, intuitive manual user controls, or automated control via computer vision or other sensor input, can be achieved using a mapping as defined by equations 11 and 12 below:

$$\text{delay} \equiv \begin{cases} \begin{bmatrix} 0 \\ |delayDelta| \end{bmatrix}, & delayDelta \geq 0 \\ \begin{bmatrix} |delayDelta| \\ 0 \end{bmatrix}, & delayDelta < 0 \end{cases} \quad \text{Eq. (11)}$$

$$\text{gain} \equiv \begin{cases} \begin{bmatrix} 0 \\ -1.5|delayDelta| \end{bmatrix}, & delayDelta \geq 0 \\ \begin{bmatrix} -1.5|delayDelta| \\ 0 \end{bmatrix}, & delayDelta < 0 \end{cases} \quad \text{Eq. (12)}$$

where delayDelta and delay are in milliseconds, and, gain is in decibels. The delay and gain column vectors assume their first component pertains to the left channel and their second to the right. Thus, delayDelta≥0 indicates left speaker delay is greater than or equal to right speaker delay, and delayDelta<0 indicates left speaker delay is less than right speaker delay.

In some embodiments, instead of applying attenuation to a channel, an equal amount of gain may be applied to the opposite channel, or a combination of gain applied to one channel and attenuation to the other channel. For example, a gain may be applied to the left channel rather than an attenuation on the left channel. For near-field listening, as occurs on mobile, desktop PC and console gaming, and home-theater scenarios, the distance deltas between a listener position and each loudspeaker are small enough, and therefore the SPL deltas between a listener position and each loudspeaker are small enough, such that any of the above mappings will serve to successfully restore the transaural spatial image while maintaining an overall acceptably loud sound stage, in comparison to an ideal listener/speaker configuration.

Example Audio System Processing

Figure 8:
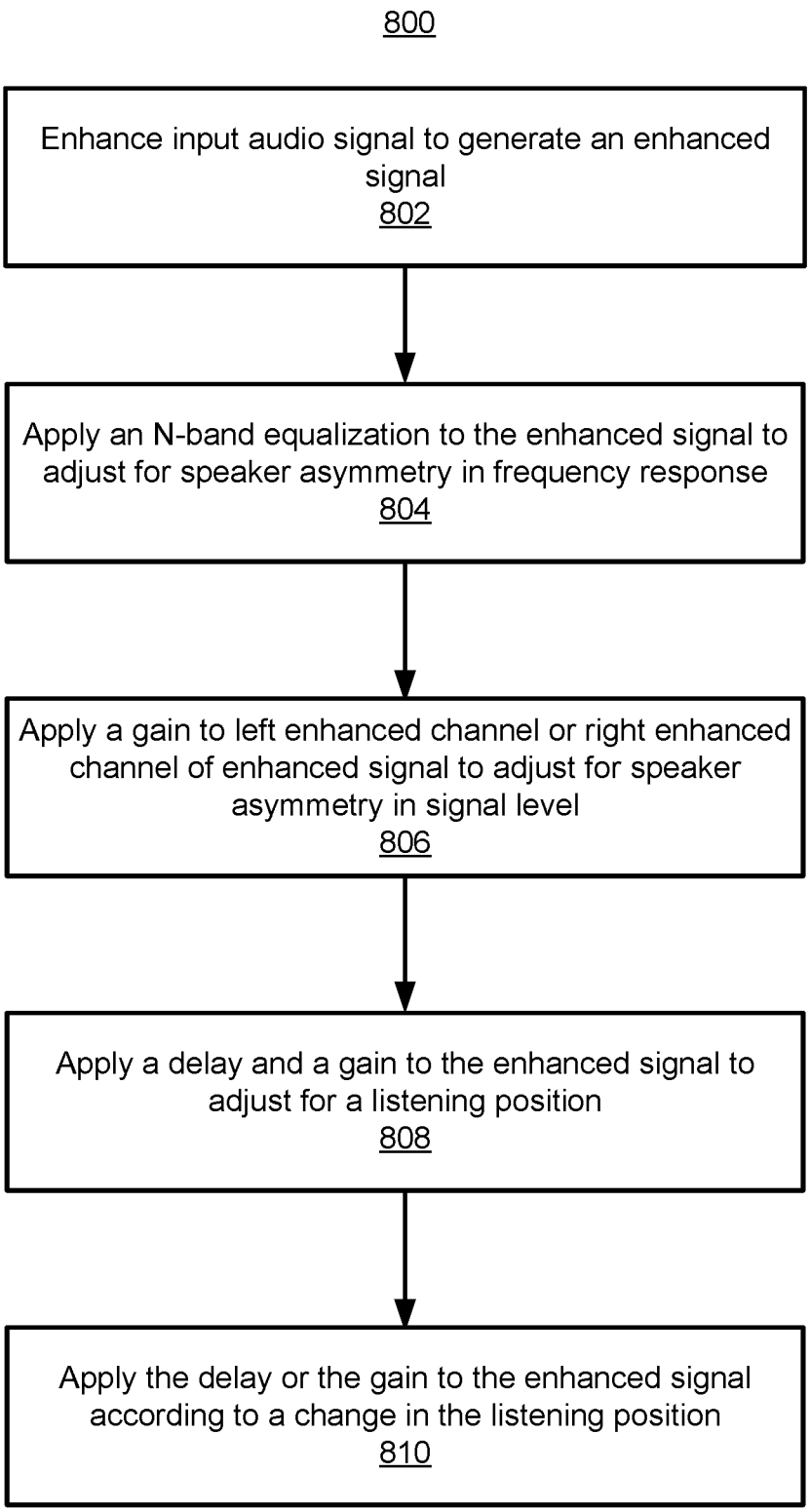
FIG. 8 is a flow chart of a method for b-chain processing of an input audio signal, in accordance with some embodiments.

FIG. 8 is a flow chart of a method 800 for processing of an input audio signal, in accordance with some embodiments. The method 800 may have fewer or additional steps, and steps may be performed in different orders.

An audio processing system 200 (e.g., the spatial enhancement processor 205) enhances 802 an input audio signal to generate an enhanced signal. The enhancement may include a spatial enhancement. For example, the spatial enhancement processor 205 applies subband spatial processing, crosstalk compensation processing, and crosstalk cancellation processing to an input audio signal X including a left input channel XL and a right input channel XR to generate an enhanced signal A including a left enhanced channel AL and a right enhanced channel AR. Here, the audio processing system 200 applies a spatial enhancement by gain adjusting the mid (nonspatial) and side (spatial) subband components of the input audio signal X, and the enhanced signal A is referred to as a "spatially enhanced signal." The audio processing system 200 may perform other types of enhancements to generate the enhanced signal A.

The audio processing system 200 (e.g., the N-band EQ 702 of the speaker matching processor 250 of the b-chain processor 240) applies 804 an N-band equalization to the enhanced signal A to adjust for an asymmetry in frequency response between a left speaker and a right speaker. The N-band EQ 702 may apply one or more filters to the left enhanced channel AL, the right enhanced channel AR, or both the left channel AL and the right channel AR. The one or more filters applied to the left enhanced channel AL and/or the right enhanced channel AR balance frequency responses of the left and right speaker. In some embodiments, balancing the frequency responses may be used to adjust for rotational offset from the ideal angle for the left or right speaker. In some embodiments, the N-band EQ 702 adjusts the asymmetry between the left and right speaker, and determines parameters of the filters for applying the N-band EQ based on the determined asymmetry.

The audio processing system 200 (e.g., left amplifier 704 and/or right amplifier 706) applies 806 a gain to at least one of the left enhanced channel AL and the right enhanced channel AR to adjust for the asymmetry between the left speaker and the right speaker in signal level. The gain that is applied may be a positive gain or a negative gain (also referred to as an attenuation) to address asymmetries in loudspeaker loudness and dynamic range capabilities, or unmatched loudspeaker pairs that have different sound pressure level (SPL) output characteristics.

The audio processing system 200 (e.g., the delay and gain processor 260 of the b-chain processor 240) applies 808 a delay and a gain to the enhanced signal A to adjust for a listening position. The listening position may include a position of a user relative to the left speaker and the right speaker. The user refers to the listener of the speakers. The delay and the gain time aligns and further perceptually balances the spatial image output from the speaker matching processor 250 for the position of the listener, given the actual physical asymmetries in the rendering/listening system (e.g., off-center head position and/or non-equivalent loudspeaker-to-head distances). For example, the left delay 708 may apply a delay and the left amplifier 712 may apply a gain to the left enhanced channel AL. The right delay 710 may apply a delay and the right amplifier 714 may apply a gain to the right enhanced channel AR. In some embodiments, a delay may be applied to one of the left enhanced channel AL or the right enhanced channel AR, and a gain may be applied to one of the left enhanced channel AL or the right enhanced channel AR.

The audio processing system 200 (e.g., the delay and gain processor 260 of the b-chain processor 240) adjusts 810 at least one of the delay and the gain according to a change in the listening position. For example, the spatial position of the user relative to the left speaker and the right speaker may change. The audio processing system 200 monitors the location of the listener over time, determines the gain and delay applied to the enhanced signal O based on the location of the listener, and adjusts the delay and gain applied to the enhanced signal O according to changes of the location of the listener over time to generate the left output channel OL and the right output channel OR.

Adjustments for various asymmetries may be performed in different orders. For example, the adjustment for asymmetry in speaker characteristics (e.g., frequency response) may be performed prior to, subsequent to, or in connection with the adjustments for asymmetry in the listening position relative to speaker location or orientation. The audio processing system may determine asymmetries between the left speaker and the right speaker in frequency response, time alignment, and signal level for a listening position; and generate a left output channel for the left speaker and a right output channel for the right speaker by: applying an N-band equalization to the spatially enhanced signal to adjust for the asymmetry between the left speaker and the right speaker in the frequency response, applying a delay to the spatially enhanced signal to adjust for the asymmetry in the time alignment, and applying a gain to the spatially enhanced signal to adjust for the asymmetry in the signal level.

In some embodiments, rather than applying multiple gains or delays to adjust for different sources of asymmetry (e.g., speaker characteristics or listening position), a single gain and a single delay are used to adjust for multiple types of asymmetry that result in gain or time delay differences between the speakers and from the vantage point of the listening position. However, it may be advantageous to separate the processing for speaker asymmetry and listening position asymmetry to reduce processing needs. For example, once speaker frequency response is known, the same filter values may be used for the speaker adjustment while different time delay and signal level adjustments are made for changes in listening position (e.g., as the user moves).

Figure 9:
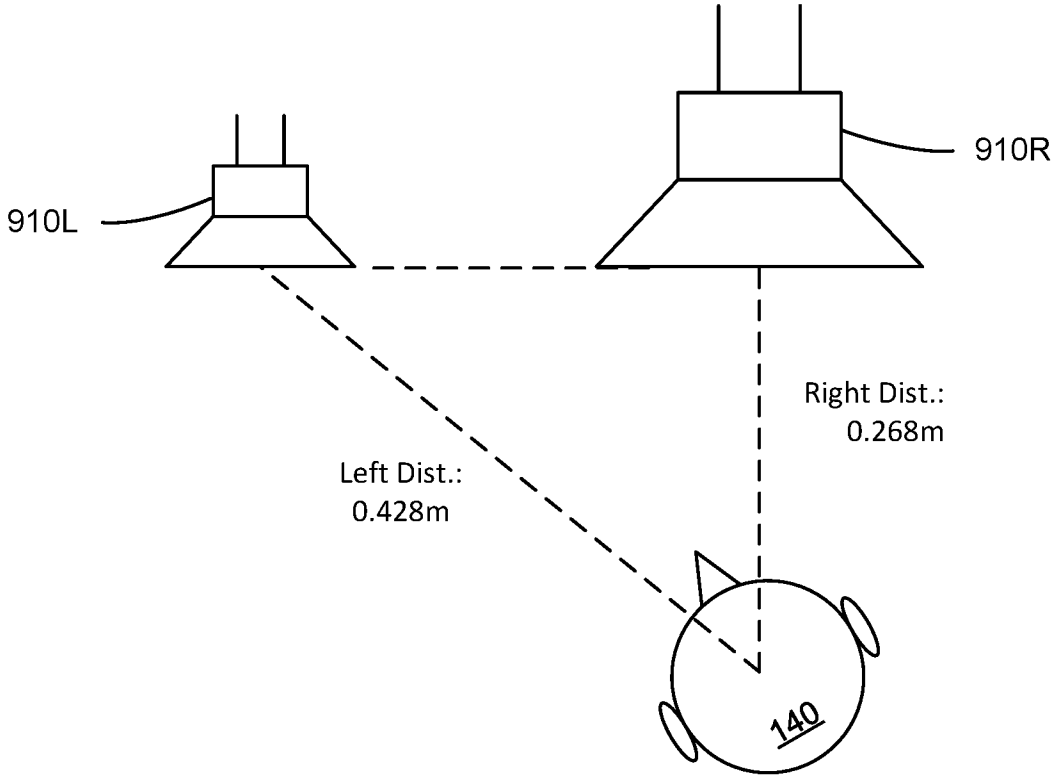
FIG. 9 illustrates a non-ideal head position and unmatched loudspeakers, in accordance with some embodiments.
Figure 10A:
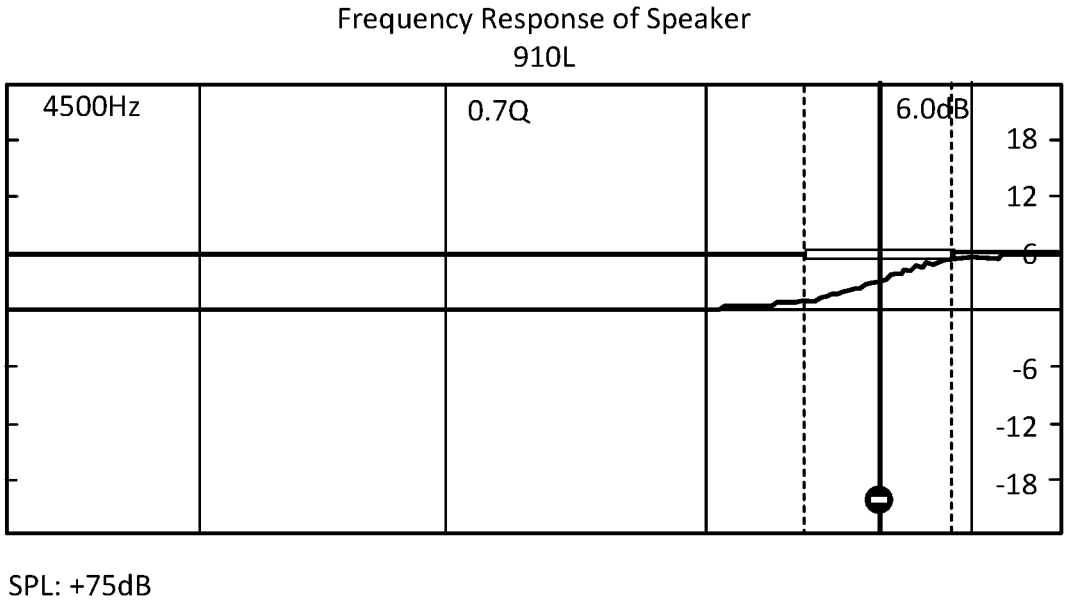
FIGS. 10A and 10B illustrate frequency responses for the non-ideal head position and unmatched loudspeakers shown in FIG. 9, in accordance with some embodiments.

FIG. 9 illustrates a non-ideal head position and unmatched loudspeakers, in accordance with some embodiments. The listener 140 is a different distance from the left speaker 910L and the right speaker 910R. Furthermore, the frequency and/or amplitude characteristics of the speakers 910L and 910R are not equivalent. FIG. 10A illustrates a frequency response of the left speaker 910L, and FIG. 10B illustrates a frequency response of the right speaker 910R.

Figure 10B:
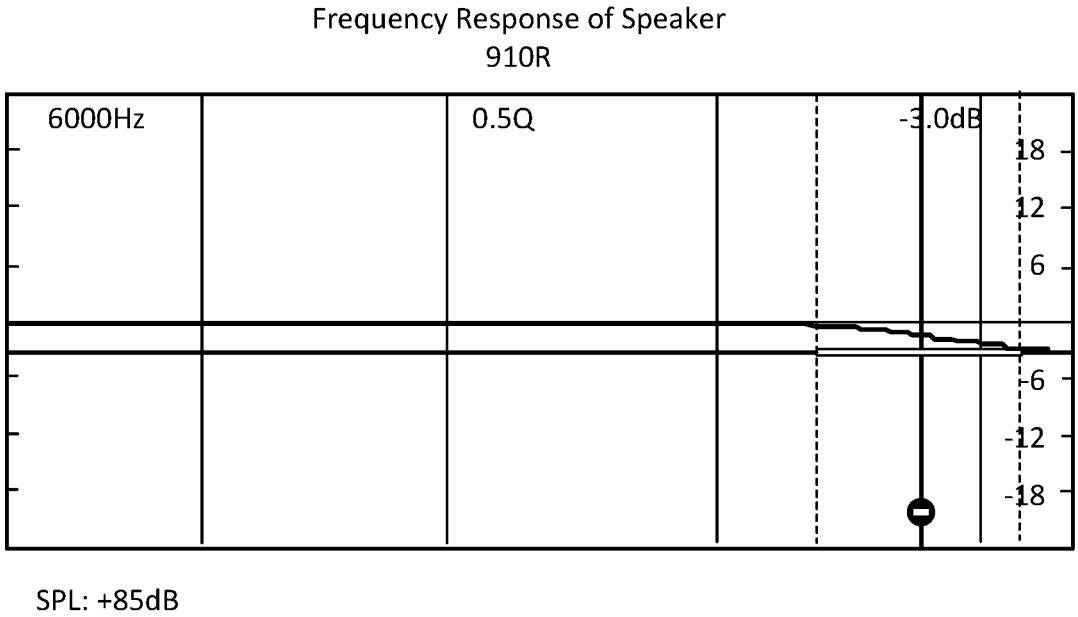

To correct for the speaker asymmetry of speakers 910L and 910R and the position of the listener 140 relative to each of the speakers 910L and 910R as shown in FIGS. 9, 10A, and 10B, the components of the b-chain processor 240 may use the following configurations. The N-band EQ 702 may apply a high-shelf filter having a cutoff frequency of 4,500 Hz, a Q value of 0.7, and a slope of −6 dB for the left enhanced channel AL, and may apply a high-shelf filter having a cutoff frequency of 6,000 Hz, a Q value of 0.5, and a slope of +3 dB for the right enhanced channel AR. The left delay 708 may apply a 0 mS delay, the right delay 710 may apply a 0.27 mS delay, the left amplifier 712 may apply a 0 dB gain, and the right amplifier 714 may apply a −0.40625 dB gain.

Example Computing System

It is noted that the systems and processes described herein may be embodied in an embedded electronic circuit or electronic system. The systems and processes also may be embodied in a computing system that includes one or more processing systems (e.g., a digital signal processor) and a memory (e.g., programmed read only memory or programmable solid state memory), or some other circuitry such as an application specific integrated circuit (ASIC) or field-programmable gate array (FPGA) circuit.

Figure 11:
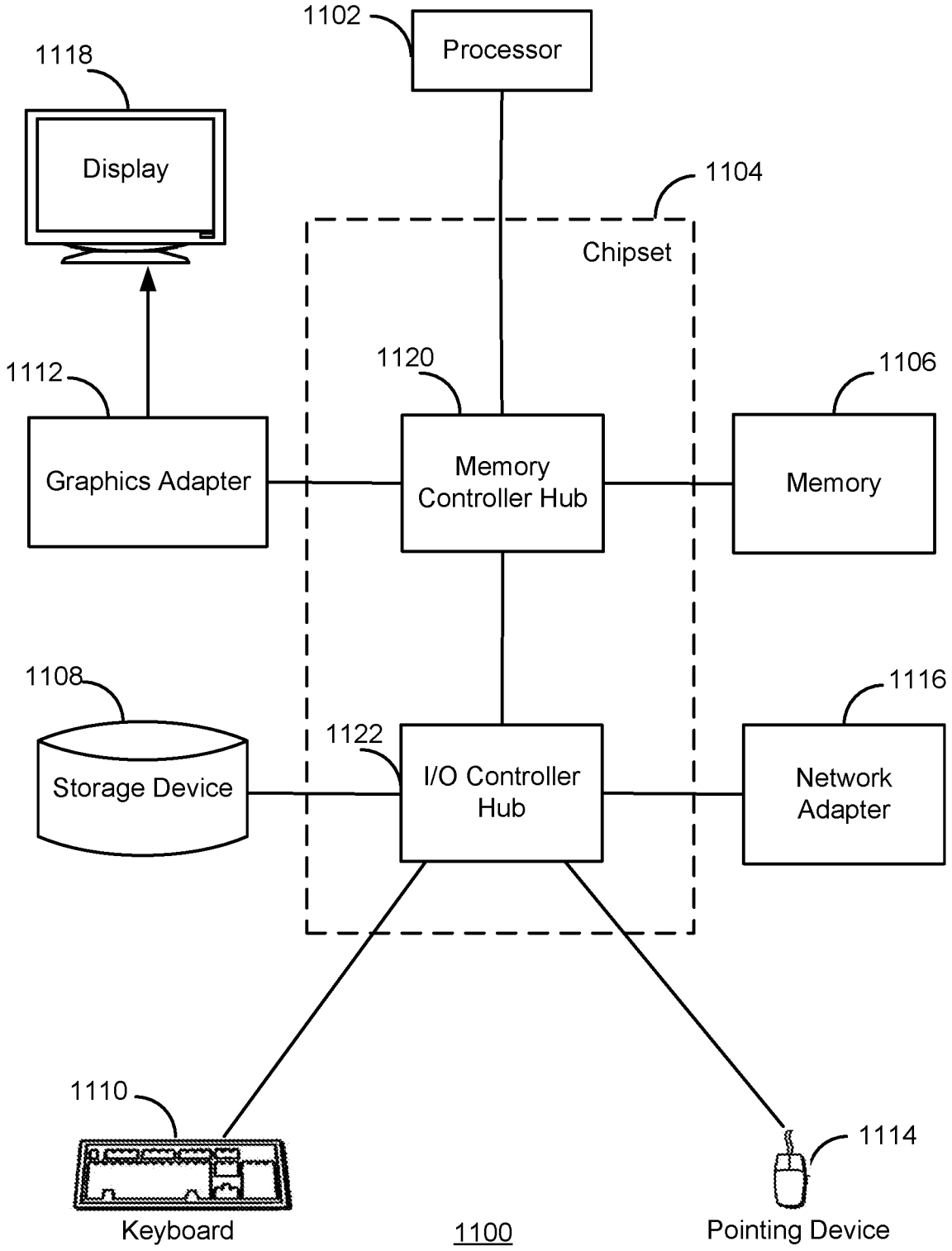
FIG. 11 is a schematic block diagram of a computer system, in accordance with some embodiments.

FIG. 11 illustrates an example of a computer system 1100, according to one embodiment. The audio system 200 may be implemented on the system 1100. Illustrated are at least one processor 1102 coupled to a chipset 1104. The chipset 1104 includes a memory controller hub 1120 and an input/output (I/O) controller hub 1122. A memory 1106 and a graphics adapter 1112 are coupled to the memory controller hub 1120, and a display device 1118 is coupled to the graphics adapter 1112. A storage device 1108, keyboard 1110, pointing device 1114, and network adapter 1116 are coupled to the I/O controller hub 1122. Other embodiments of the computer 1100 have different architectures. For example, the memory 1106 is directly coupled to the processor 1102 in some embodiments.

The storage device 1108 includes one or more non-transitory computer-readable storage media such as a hard drive, compact disk read-only memory (CD-ROM), DVD, or a solid-state memory device. The memory 1106 holds instructions and data used by the processor 1102. For example, the memory 1106 may store instructions that when executed by the processor 1102 causes or configures the processor 1102 to perform the functionality discussed herein, such as the method 800. The pointing device 1114 is used in combination with the keyboard 1110 to input data into the computer system 1100. The graphics adapter 1112 displays images and other information on the display device 1118. In some embodiments, the display device 1118 includes a touch screen capability for receiving user input and selections. The network adapter 1116 couples the computer system 1100 to a network. Some embodiments of the computer 1100 have different and/or other components than those shown in FIG. 11. For example, the computer system 1100 may be a server that lacks a display device, keyboard, and other components, or may use other types of input devices.

Additional Considerations

The disclosed configuration may include a number of benefits and/or advantages. For example, an input signal can be output to unmatched loudspeakers while preserving or enhancing a spatial sense of the sound field. A high quality listening experience can be achieved even when the speakers are unmatched or when the listener is not in an ideal listening position relative to the speakers.

Upon reading this disclosure, those of skill in the art will appreciate still additional alternative embodiments of the disclosed principles herein. Thus, while particular embodiments and applications have been illustrated and described, it is to be understood that the disclosed embodiments are not limited to the precise construction and components disclosed herein. Various modifications, changes and variations, which will be apparent to those skilled in the art, may be made in the arrangement, operation and details of the method and apparatus disclosed herein without departing from the scope described herein.

Any of the steps, operations, or processes described herein may be performed or implemented with one or more hardware or software modules, alone or in combination with other devices. In one embodiment, a software module is implemented with a computer program product comprising a computer readable medium (e.g., non-transitory computer readable medium) containing computer program code, which can be executed by a computer processor for performing any or all of the steps, operations, or processes described.

What is claimed is:

1. A system for enhancing an input audio signal for a left speaker and a right speaker, comprising:

a processing circuitry configured to:

determine asymmetries between the left speaker and the right speaker in frequency response, time alignment, and signal level for a listening position; and generate a left output channel for the left speaker and a right output channel for the right speaker by at least one of:

applying an N-band equalization to the input audio signal to adjust for the asymmetry in the frequency response;

applying a delay to the input audio signal to adjust for the asymmetry in the time alignment; or applying a gain to the input audio signal to adjust for the asymmetry in the signal level.

2. The system of claim 1, wherein the processing circuitry is configured to apply the N-band equalization by applying one or more filters to at least one of a left channel or a right channel of the input audio signal.

3. The system of claim 2, wherein the one or more filters balance frequency responses of the left speaker and the right speaker.

4. The system of claim 2, wherein the one or more filters include at least one of:

a low-shelf filter and a high shelf filter;

a band-pass filter;

a band-stop filter;

a peak-notch filter; and a low-pass filter and a high-pass filter.

5. The system of claim 1, wherein the processing circuitry is configured to apply the delay to the input audio signal by applying the delay to one of a left channel or a right channel of the input audio signal.

6. The system of claim 1, wherein the processing circuitry is configured to apply the gain to the input audio signal by applying the gain to one of a left channel or a right channel of the input audio signal.

7. The system of claim 1, wherein:

the processing circuitry is configured to apply the delay and the gain to the input audio signal; and processing circuitry is further configured to adjust at least one of the delay and the gain according to a change in the listening position.

8. The system of claim 1, wherein:

the processing circuitry is configured to apply the delay and the gain to the input audio signal; and the delay and the gain adjust for the listening position being a non-equivalent distance from the left speaker and the right speaker.

9. The system of claim 1, wherein the processing circuitry is further configured to apply at least one of a crosstalk compensation or a crosstalk cancellation to the input audio signal.

10. The system of claim 1, wherein the processing circuitry is further configured to gain adjust spatial components and nonspatial components of the input audio signal.

11. A non-transitory computer readable medium storing instructions that, when executed by at least one processor, configure the at least one processor to:

determine asymmetries between a left speaker and a right speaker in frequency response, time alignment, and signal level for a listening position; and generate a left output channel for the left speaker and a right output channel for the right speaker by at least one of:

applying an N-band equalization to the input audio signal to adjust for the asymmetry in the frequency response;

applying a delay to the input audio signal to adjust for the asymmetry in the time alignment; or applying a gain to the input audio signal to adjust for the asymmetry in the signal level.

12. The non-transitory computer readable medium of claim 11, wherein the instructions configure the at least one processor to apply the N-band equalization by applying one or more filters to at least one of a left channel or a right channel of the input audio signal.

13. The non-transitory computer readable medium of claim 12, wherein the one or more filters balance frequency responses of the left speaker and the right speaker.

14. The non-transitory computer readable medium of claim 12, wherein the one or more filters include at least one of:

a low-shelf filter and a high shelf filter;

a band-pass filter;

a band-stop filter;

a peak-notch filter; and a low-pass filter and a high-pass filter.

15. The non-transitory computer readable medium of claim 11, wherein the instructions configure the at least one processor to apply the delay to the input audio signal by applying the delay to one of a left channel or a right channel of the input audio signal.

16. The non-transitory computer readable medium of claim 11, wherein the instructions configure the at least one processor to apply the gain to the input audio signal by applying the gain to one of a left channel or a right channel of the input audio signal.

17. The non-transitory computer readable medium of claim 11, wherein:

the instructions configure the at least one processor to apply the delay and the gain to the input audio signal; and the instructions further configure the at least one processor to adjust at least one of the delay and the gain according to a change in the listening position.

18. The non-transitory computer readable medium of claim 11, wherein:

the instructions further configure the at least one processor to apply the delay and the gain to the input audio signal; and the delay and the gain adjust for the listening position being a non-equivalent distance from the left speaker and the right speaker.

19. The non-transitory computer readable medium of claim 11, wherein the instructions further configure the at least one processor to apply at least one of a crosstalk compensation or a crosstalk cancellation to the input audio signal.

20. The non-transitory computer readable medium of claim 11, wherein the instructions further configure the at least one processor to gain adjust spatial components and nonspatial components of the input audio signal.

21. A method for enhancing an input audio signal for a left speaker and a right speaker, comprising, by a processing circuitry:

determine asymmetries between the left speaker and the right speaker in frequency response, time alignment, and signal level for a listening position; and generating a left output channel for the left speaker and a right output channel for the right speaker by at least one of:

applying an N-band equalization to the input audio signal to adjust for the asymmetry in the frequency response;

applying a delay to the input audio signal to adjust for the asymmetry in the time alignment; or applying a gain to the input audio signal to adjust for the asymmetry in the signal level.

22. The method of claim 21, wherein applying the N-band equalization includes applying one or more filters to at least one of a left channel or a right channel of the input audio signal.

23. The method of claim 22, wherein the one or more filters balance frequency responses of the left speaker and the right speaker.

24. The method of claim 22, wherein the one or more filters include at least one of:

a low-shelf filter and a high shelf filter;

a band-pass filter;

a band-stop filter;

a peak-notch filter; and a low-pass filter and a high-pass filter.

25. The method of claim 21, wherein applying the delay to the input audio signal includes applying the delay to one of a left channel or a right channel of the input audio signal.

26. The method of claim 21, wherein applying the gain to the input audio signal includes applying the gain to one of a left channel or a right channel of the input audio signal.

27. The method of claim 21, wherein the method includes:

applying the delay and the gain to the input audio signal; and adjusting at least one of the delay and the gain according to a change in the listening position.

28. The method of claim 21, wherein:

the method includes applying the delay and the gain to the input audio signal; and the delay and the gain adjust for the listening position being a non-equivalent distance from the left speaker and the right speaker.

29. The method of claim 21, further comprising applying at least one of a crosstalk compensation or a crosstalk cancellation to the input audio signal.

30. The method of claim 21, further comprising gain adjusting spatial components and nonspatial components of the input audio signal.

* * * * *